US008603710B2

(12) United States Patent
Yu

(10) Patent No.: US 8,603,710 B2
(45) Date of Patent: Dec. 10, 2013

(54) ALTERNATE ANTICURL BACK COATING FORMULATION

(75) Inventor: Robert C. U. Yu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 22 days.

(21) Appl. No.: 13/312,830

(22) Filed: Dec. 6, 2011

(65) Prior Publication Data

US 2013/0143016 A1 Jun. 6, 2013

(51) Int. Cl.
*G03G 5/10* (2006.01)

(52) U.S. Cl.
USPC ..... 430/69; 430/56

(58) Field of Classification Search
USPC ..... 430/69, 56, 59.6, 96
See application file for complete search history.

(56) References Cited

U.S. PATENT DOCUMENTS

| | | | | |
|---|---|---|---|---|
| 3,121,006 | A | 2/1964 | Middleton et al. | |
| 4,338,387 | A | 7/1982 | Hewitt | |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,382,486 | A | 1/1995 | Yu et al. | |
| 5,725,983 | A * | 3/1998 | Yu | 430/58.05 |
| 5,756,245 | A | 5/1998 | Esteghamatian et al. | |
| 6,939,652 | B2 * | 9/2005 | Yu | 430/69 |
| 7,166,399 | B2 | 1/2007 | Carmichael et al. | |
| 7,455,941 | B2 | 11/2008 | Evans et al. | |
| 7,462,434 | B2 | 12/2008 | Yu et al. | |
| 7,662,525 | B2 * | 2/2010 | Wu et al. | 430/56 |
| 7,670,736 | B2 * | 3/2010 | Yuh et al. | 430/58.8 |
| 2011/0305981 | A1 * | 12/2011 | Yu et al. | 430/56 |

OTHER PUBLICATIONS

Diamond, A.S., ed., Handbook of Imaging Materials, Marcel Dekker, Inc., NY (1991), pp. 395-396.*

* cited by examiner

*Primary Examiner* — Janis L Dote
(74) *Attorney, Agent, or Firm* — Pillsbury Winthrop Shaw Pittman LLP

(57) ABSTRACT

The presently disclosed embodiments related generally to a layer that provides overall flatness to flexible imaging members and components for use in electrostatographic apparatuses. More particularly, the embodiments pertain to a flexible electrophotographic imaging member belt prepared to include an anti-curl back coating formulated to comprise a mechanically robust copolymer binder that does have enhanced wear resistance and improved imaging member curl control.

27 Claims, 2 Drawing Sheets

ALTERNATE ANTICURL BACK COATING FORMULATION

BACKGROUND

The presently disclosed embodiments relate generally to the formulation of a layer that provides overall flatness to flexible imaging members and components for use in electrostatographic apparatuses. More particularly, the embodiments pertain to a flexible electrophotographic imaging member belt prepared to include an anti-curl back coating formulated to comprise a mechanically robust copolymer binder that does have enhanced wear resistance and improved imaging member curl control.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper.

The flexible electrostatographic imaging members may be seamless or seamed belts. A seamed belt is usually formed by cutting a rectangular imaging member sheet from a web stock, overlapping a pair of opposite ends, and welding the overlapped ends together to form a welded seam belt. Typical electrophotographic imaging member belts that include a charge transport layer and a charge generating layer on one side of a supporting substrate layer exhibit undesirable upward curling. Thus, an anti-curl back coating is usually coated onto the opposite side of the substrate layer to render imaging member belts flatness. A typical electrographic imaging member belt has a more simple material structure. It includes only a dielectric imaging layer on one side of a supporting substrate, yet an anti-curl back coating is usually needed on the opposite side of the substrate for curl control and render desired flatness.

In electrophotography, the surface of an electrophotographic plate, drum, belt or the like (imaging member or photoreceptor) containing a photoconductive insulating layer on a conductive layer is first uniformly electrostatically charged. The imaging member is exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Multilayered flexible photoreceptors or imaging members have at least two layers, and may include a flexible substrate, a conductive layer, an optional undercoat layer ("charge blocking layer" or "hole blocking layer"), an optional adhesive layer, a photogenerating layer ("charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer and the charge transport layer. Enhancement of charge transporting capability across these layers provides better photoreceptor performance. Multilayered flexible photoreceptor members may include an anti-curl back coating layer on the backside of the substrate, opposite to the side of the electrically active layers, to render the desired photoreceptor flatness.

In current organic belt photoreceptors, an anticurl back coating layer is used to balance pulling force, caused by internal tension stress/strain built-up in the charge transport layer of the photoreceptor, and eliminate the upward curling. In addition, the anti-curl back coating layer should have optically suitable transmittance, for example, good transparency, so that the photoreceptor can be erased by radiation directed from the backside of the belt during electrophotographic imaging processes. In addition, since imaging member belt is encircled around and supported by a number of belt module rollers and backer bars, the anticurl back coating layer should also be mechanically robust to provide adequate wear resistance to withstand the frictional action against these belt module support components, under a dynamic belt cyclic machine functioning condition in the field.

During the manufacturing process of flexible imaging members, the charge transport layer (CTL) is coated over the charge generation layer (CGL) by applying a CTL solution coating on top of the CGL, then subsequently drying the wet applied CTL coating at elevated temperatures of about 120° C., and finally cooling down the coated photoreceptor to the ambient room temperature of about 25° C. Due to the thermal contraction mismatch between the CTL and the substrate support, the processed photoreceptor web (with finished CTL coating obtained through drying/cooling process) spontaneous curls upwardly into a roll. For example, a photorecptor web having a 29-micrometer CTL thickness and a 3½ mil polyethylene naphthalate substrate may spontaneously curl-up into a 1½-inch roll.

Typically, the CTL in a photoreceptor device has a coefficient of thermal contraction of from about 3 to about 4 times, or approximately 3.7 times, greater than that of the flexible substrate support. As a result, the CTL has a larger dimensional shrinkage than that of the flexible substrate support after through the process of application of wet CTL coating, drying it at elevated temperature, and the eventual photoreceptor web cools down to the ambient room temperature. The exhibition of photoreceptor web curling up after the completion of CTL coating is due to the consequence of larger CTL contraction as a result of the heating/cooling cycles of the manufacturing processing step. Without being bounded by theory, the development of the upward curling may be explained by the following mechanisms: (1) while the photoreceptor web after application of wet CTL coating is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction; (2) during the cool down period, the temperature falls and reaches the glass transition temperature (Tg) of the CTL at 85° C., the CTL instantaneously solidifies and adheres to the underneath CGL as it transforms from being a viscous liquid into a solid layer; (3) as the temperature drops from 85° C. down to the 25° C. room ambient, the solid CTL of the photoreceptor web laterally contracts more than the flexible substrate support due to the higher thermal coefficient of dimensional contraction than that of the substrate support. Such differential in dimensional contraction results in tension strain built-up in the CTL, which pulls the photoreceptor web upwardly to exhibit curling.

To offset the curling, an anti-curl back coating (ACBC) is applied to the backside of the flexible substrate support, opposite to the side with a CTL, and render the photoreceptor web with desired flatness. Such ACBC should have optically suitable transmittance (e.g., transparency), so that the residual voltage remaining after completion of a photoelectrical imaging process on the photoreceptor surface can be erased by radiation illumination from the back side (ACBC side) of the belt during electrophotographic imaging processes. Unfortunately, the current ACBC formulations contain bisphenol polycarbonate which has limited wear resistance. The current ACBC formulation is not ideal for withstanding the frictional interaction against the machine belt support module components during usage of the image-forming apparatus. For example, such frictional interaction may increase belt drag in the image-forming apparatus and increases the load duty on the motor. The ease of material wear-off from ACBC layer generates dust and dirt debris build up inside the machine cavity, thereby negatively impacting the quality of dynamic belt motion to cause manifestation into copy printout defects. Moreover, the exacerbation of ACBC layer wear under a normal machine electrophotographic imaging belt function condition makes the layer thinner resulting in the loss of curl control for maintaining effective imaging member flatness.

Therefore, there is a need to provide an ACBC formulation which improves physical and mechanical function and does not have the described shortfalls. There is also a need to provide improved imaging members that have mechanically robust outer ACBC layer having reduced surface contact friction and less susceptibility to scratch/wear failure to effect service life extension without creating other undesirable problems.

SUMMARY

According to aspects illustrated herein, there is provided a flexible imaging member comprising a flexible substrate; a charge generating layer disposed on the substrate; a charge transporting layer disposed on the charge generating layer; and an anti-curl back coating disposed on the substrate on a side opposite to the charge transport layer, the anti-curl back coating comprising a copolymer of Formula I:

$$R_1-(\text{[Block A]-[Block B]})_n-OH$$

wherein Block A has the following structure:

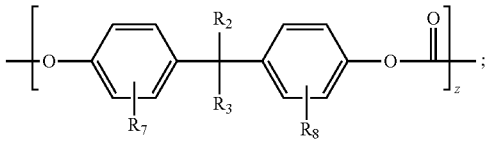

Block B has the following structure:

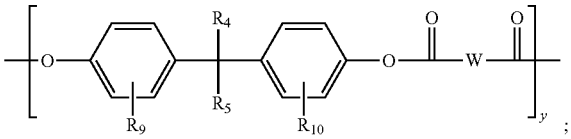

$R_1$ is H or $CH_3$; each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_7$, $R_8$, $R_9$, $R_{10}$ is independently H or lower $C_1$-$C_3$ alkyl; W is an aryl or alkylene having from 2 carbon atoms to 10 carbon atoms; y is between about 1 and about 2; z is between about 9 and about 18; and n is between about 20 and about 80.

In another embodiment, there is provided a flexible imaging member comprising a substrate; a charge generating layer disposed on the substrate; a charge transporting layer disposed on the charge generating layer; and an anti-curl back coating disposed on the substrate on a side opposite to the charge transport layer, the anti-curl back coating comprising a copolymer having a Formula II:

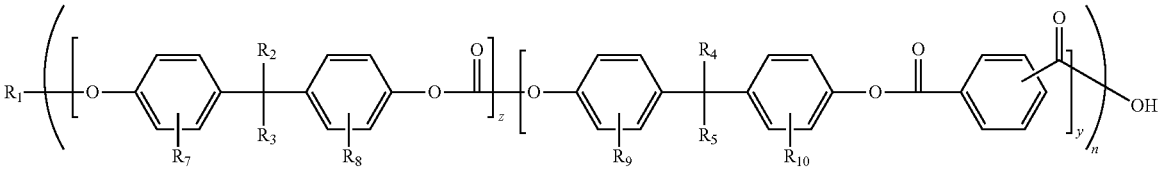

wherein $R_1$ is H or $CH_3$; each $R_2$, $R_3$ is independently methyl, or $R_2$ and $R_3$ taken together with the C atom to which they are attached form a cyclohexane, where any ring atom of the cyclohexane may be optionally substituted with one or more methyl; each $R_4$, $R_5$ is independently methyl, or $R_4$ and $R_5$ taken together with the C atom to which they are attached form a cyclohexane, where any ring atom of the cyclohexane may be optionally substituted with one or more methyl; each $R_7$, $R_8$, $R_9$, $R_{10}$ is independently H or methyl; y is between about 1 and about 6; z is between about 9 and about 18; and n is between about 20 and about 80.

In yet another embodiment, there is provided a flexible imaging member comprising:

a substrate;

a charge generating layer disposed on the substrate;

a charge transporting layer disposed on the charge generating layer; and an anticurl back coating disposed on the substrate on a side opposite to the charge transport layer, the anticurl back coating comprising a copolymer having a Formula III:

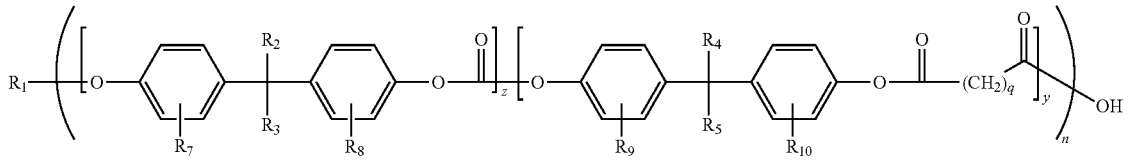

wherein $R_1$ is H or $CH_3$;

each $R_2$, $R_3$ is independently methyl, or $R_2$ and $R_3$ taken together with the C atom to which they are attached form a cyclohexane, where any ring atom of the cyclohexane may be optionally substituted with one or more methyl;

each $R_4$, $R_5$ is independently methyl, or $R_4$ and $R_5$ taken together with the C atom to which they are attached form a cyclohexane, where any ring atom of the cyclohexane may be optionally substituted with one or more methyl;

each $R_7$, $R_8$, $R_9$, $R_{10}$ is independently H or methyl;

y is between about 1 and about 6;

z is between about 9 and about 18;

n is between about 20 and about 80; and q is between 3 and 8.

BRIEF DESCRIPTION OF THE DRAWINGS

For a better understanding, reference may be made to the accompanying figures. The Figures demonstrate cross-sectional views of a multiple layered electrophotographic imaging member in a flexible belt configuration comprising an improved anti-curl back coating layer formulation prepared according to the material composition description of present disclosure embodiments. The following is a brief description of the drawings, which are presented for the purposes of illustrating the exemplary embodiments disclosed herein and not for the purposes of limiting the same.

DETAILED DESCRIPTION

Figure 1:
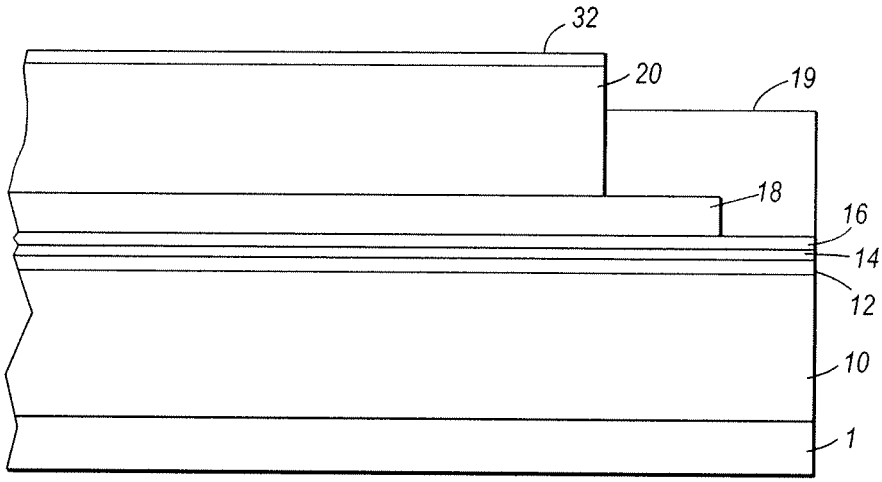
FIG. 1 is a schematic cross-sectional view of a first exemplary embodiment of a flexible imaging member having an anti-curl back coating prepared according to the description of present disclosure.

In the following description, reference is made to the accompanying drawings, which form a part hereof and which illustrate the exemplary embodiments of the present disclosure herein and not for the purpose of limiting the same. It is also understood that other embodiments may be utilized and structural and operational changes may be made without departure from the scope of the present disclosure.

The disclosure provides a conventional flexible multiple layered electrophotographic imaging member, having an optional top outermost protective overcoat layer, a charge transport layer (CTL) over a charge generation layer (CGL), a flexible supporting substrate, and an anti-curl back coating (ACBC) layer comprising an A-B diblock copolymer described in the disclosure. The flexible multiple layered electrophotographic imaging member of this configuration is a negatively charged imaging member.

The exemplary embodiments of this disclosure are further described below with reference to the accompanying figures. The specific terms are used in the following description for clarity, selected for illustration in the drawings and not to define or limit the scope of the disclosure. The structures in the figures are not drawn according to their relative proportions and the drawings should not be interpreted as limiting the disclosure in size, relative size, or location. In addition, though the discussion will address negatively charged systems, the imaging members of the present disclosure may also included material compositions designed to be used in positively charged systems. Also the term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

FIG. 1 illustrates an exemplary embodiment of a negatively charged flexible multi-layered electrophotographic imaging member. Specifically, shows a flexible multiple layered electrophotographic imaging member comprising an ACBC 1, a substrate 10, an optional a conductive layer 12, an optional hole blocking layer 14 over the optional conductive layer 12, and an optional adhesive layer 16 over the blocking layer 14, a charge generating layer (CGL) 18, a charge transport layer (CTL) 20, an optional ground strip layer 19 operatively connects the CGL 18 and the CTL 20 to the optional conductive layer 12, and an over coat layer 32. An optional ground strip layer 19 may be included to effect electrical continuity. An overcoat layer 32 may optionally be included to provide abrasion/wear protection to the CTL 20. Typically, an ACBC layer 1 is required and being the outermost layer to be applied onto the side of substrate 10, opposite to the electrically active layers, for curl control and rendering the imaging member desired flatness.

Embodiments of present disclosure are directed generally to an improved flexible electrostatographic imaging member, particularly the flexible multiple layered electrophotographic imaging member or photoreceptor, in which the ACBC is formulated to have improve mechanical function, effect best curl control, and render desirable imaging member flatness. The ACBC of present disclosure is a formulation by utilizing a high molecular weight film forming copolymer binder.

Referring back to FIG. 1, an embodiment of a negatively charged flexible multiple layered electrophotographic imaging member having a belt configuration is shown. As can be seen, the belt configuration is provided with an anti-curl back coating (ACBC) 1, a supporting substrate 10, an electrically conductive ground plane 12, a hole blocking layer 14, an adhesive layer 16, a charge generation layer (CGL) 18, and a charge transport layer (CTL) 20. An optional overcoat layer 32 and ground strip 19 may also be included. An exemplary photoreceptor having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary photoreceptors and photoreceptor layers such as a conductive ACBC layer.

Although the formation and coating of the CGL 18 and the CTL 20 of the negatively charged imaging member described and shown in all the four the figures here has two separate layers, nonetheless it may also be appreciated that the functional components of these layers be alternatively combined and formulated into a single layer to give a structurally simplified imaging member. However, the CGL 18 may also be disposed on top of the CTL 20, so the imaging member as prepared is therefore converted into a positively charge imaging member.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate (PET) from DuPont, or polyethylene naphthalate (PEN) available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in the figure, the belt can be seamed or seamless. In other embodiments, the photoreceptor herein is rigid and is in a drum configuration.

The thickness of the substrate 10 of a flexible belt depends on numerous factors, including flexibility, mechanical performance, and economic considerations. The thickness of the flexible support substrate 10 of the present embodiments may be between about 1.0 and about 7.0 mils, or from about 2.0 to about 5.0 mils, for optimum mechanical function.

An exemplary flexible substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$/° C. to about $3\times10^{-5}$/° C. and a Young's Modulus of between about $5\times10^{5}$ psi ($3.5\times10^{4}$ Kg/cm$^2$) and about $7\times10^{5}$ psi ($4.9\times10^{4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

In optional embodiments of the hole blocking may alternatively be prepared as an undercoat layer which may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The Adhesive Layer

An optional separate adhesive interface layer 16 may be provided in certain configurations, such as for example, in flexible web configurations. In the embodiment illustrated in the Figure, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik Inc., 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of at least about 0.01 micrometers, So no more than about 900 micrometers after drying. In embodiments, the dried thickness is from about 0.03 micrometers to about 1 micrometer.

The Ground Strip Layer

The ground strip layer 19 may comprise a film-forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 19 may have a thickness of at least about 7 micrometers, or no more than about 42 micrometers, or of at least about 14 micrometers, or no more than about 27 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, Ill, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, Ill, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the CGL 18 may have a thickness of at least about 0.1 μm, or no more than about 2 micrometers, or of at least about 0.2 micrometer, or no more than about 1 micrometer. These embodiments may be comprised of chlorogallium phthalocyanine or hydroxygallium phthalocyanine or mixtures thereof. The CGL 18 containing the charge generating material and the resinous binder material generally ranges in thickness of at least about 0.1 micrometer, or no more than about 5 micrometers, for example, from about 0.2 micrometer to about 3 micrometers when dry. The CGL thickness is therefore generally related to binder content. Higher binder content compositions generally employ thicker layers for charge generation.

The Charge Transport Layer

Although the CTL will be discussed specifically in terms of a single layer 20, but the details will be also applicable to an embodiment having dual or multiple charge transport layers. The CTL 20 is typically a coating solution applied over the CGL 18 and may include any suitable transparent organic polymer or non-polymeric material capable of supporting the injection of photogenerated holes or electrons from the CGL 18 and capable of allowing the transport of these holes/electrons through the charge transport layer to selectively discharge the surface charge on the imaging member surface. In one embodiment, the CTL 20 not only serves to transport holes, but also protects the charge generation layer 18 from abrasion or chemical attack and may therefore extend the service life of the imaging member. The CTL 20 can be a substantially non-photoconductive material, but one which supports the injection of photogenerated holes from the CGL 18.

The CTL 20 is normally transparent in a wavelength region in which the electrophotographic imaging member is to be used when exposure is affected there to ensure that most of the incident radiation is utilized by the underlying charge generation layer 18. The CTL should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the CGL 18 is sandwiched between the substrate and the CTL 20. The CTL 20 in conjunction with the CGL 18 is an insulator to the extent that an electrostatic charge placed on the CTL is not conducted in the absence of illumination. The CTL 20 should trap minimal charges as the charge passes through it during the discharging process.

The CTL 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film-forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the CTL 20 in order to discharge the surface charge on the CTL. The high mobility charge transport component may comprise small molecules of an organic compound which cooperate to transport charge between molecules and ultimately to the surface of the CTL 20. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the CTL, which layer generally is of a thickness of from about 5 to about 75 micrometers, and more specifically, of a thickness of from about 15 to about 40 micrometers. Examples of charge transport components are aryl amines of the following formulas:

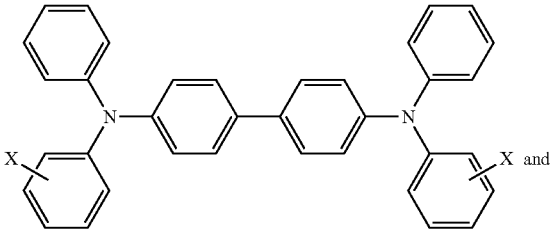

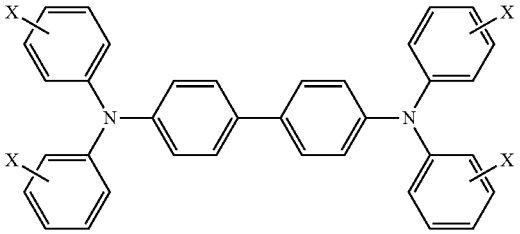

wherein each X is independently an alkyl, alkoxy, aryl, and derivatives thereof, or a halogen, or mixtures thereof, and especially $C_1$ and $CH_3$. Examples of charge transport components are also aryl amines of the following formulas:

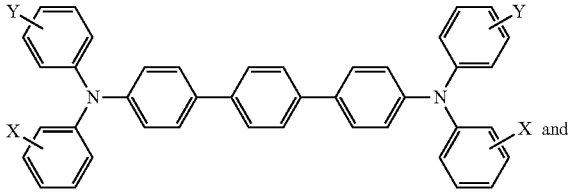

-continued

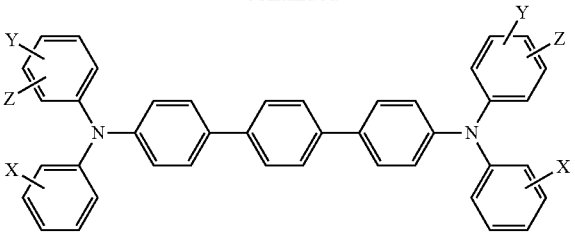

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 micrometers, or no more than about 40 micrometers.

In specific embodiments, the CTL 20 is a solid solution including a charge transport compound, such as N,N'-diphenyl-N,N'-bis(3-methylphenyl)-1,1'-biphenyl-4,4'-diamine, molecularly dissolved in a film forming polycarbonate binder, the film forming binder being either a bisphenol A polycarbonate of poly(4,4'-isopropylidene diphenyl carbonate) or a poly(4,4'-diphenyl-1,1'-cyclohexane carbonate). The Bisphenol A polycarbonate used for typical charge transport layer formulation is MAKROLON which is commercially available from Farbensabricken Bayer A.G or is the FPC 0170 available from Mitsubishi Chemicals. This commercial bisphenol A polycarbonate, poly(4,4'-isopropylidene diphenyl carbonate), has a molecular weight of about 120,000 to 150,000 and a molecular structure of given in Formula X below:

Formula X

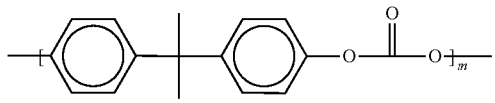

wherein m indicates the degree of polymerization. Alternatively, poly(4,4'-diphenyl-1,1'-cyclohexane carbonate) may instead be used in place of binder bisphenol A polycarbonate of poly(4,4'-isopropylidene diphenyl carbonate) of Formula (A). The molecular structure of poly(4,4'-diphenyl-1,1'-cyclohexane carbonate), having a weight average molecular weight of about between about 20,000 and about 200,000, is given in Formula Y below:

Formula Y

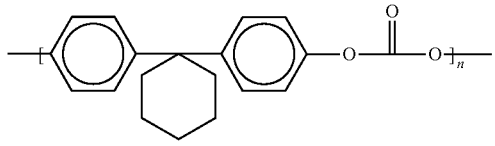

wherein n indicates the degree of polymerization.

The CTL should be an insulator to the extent that the electrostatic charge placed on the CTL surface is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the CTL coating solution to the supporting substrate layer. The CTL may be formed in a single coating step to give single CTL or in multiple coating steps to produce dual layered and multiple layered CTLs. Dip coating, ring coating, spray, gravure or any other coating methods may be used. For dual layered design, the CTL is comprised of a top CTL and a bottom CTL in contiguous contact with the CGL. In certain embodiments, the top CTL contains lesser charge transport compound than the bottom CTL for impacting mechanically robust function. Although the top and bottom CTLs may have different thickness, they may have the same thickness.

Drying of the applied wet coating layer or layers may be effected by any suitable conventional technique such as oven drying, infra red radiation drying, air drying and the like. The thickness of the CTL (being a single, dual, or multiple layered CTLs) after drying is from about 10 micrometers to about 40 micrometers or from about 12 micrometers to about 36 micrometers for optimum photoelectrical and mechanical results. In another embodiment the thickness is from about 14 micrometers to about 36 micrometers.

The conventional CTL 20 does typically have a Young's Modulus in the range of from about $2.5\times10^5$ psi ($1.7\times10^4$ Kg/cm$^2$) to about $4.5\times10^5$ psi ($3.2\times10^4$ Kg/cm$^2$) and a thermal contraction coefficient of between about $6\times10^{-5}$/° C. and about $8\times10^{-5}$/° C.

Since the CTL 20, applied by extrusion solution coating process over the GL 18 and dried at elevated temperature then followed by subsequent cooling down to room ambient, does typically have a substantially 3.7 times greater thermal contraction coefficient constant compared to that of the support substrate 10, the prepared flexible electrophotographic imaging member will, at this point if unrestrained, exhibit spontaneous upward curling due to the result of larger dimensional shrinkage in the CTL than that of the support substrate. That is due to the fact that as the imaging member (containing both CTL and substrate) cools down from $Tg_{CTL}$ of the CTL to room ambient temperature of 25° C. after the heating/drying and eventual cooling processes of the applied wet CTL coating. Therefore, internal tensile pulling strain built-up in the CTL, caused by differential dimensional contraction between CTL and substrate to result in spontaneous upward imaging member curling; can be calculated according to the expression of equation (1) below:

$$\in=(\alpha_{CTL}-\alpha_{sub})(Tg_{CTL}-25^\circ\text{ C.}) \quad (1)$$

wherein $\in$ is the internal strain build-in in the charge transport layer, $\alpha_{CTL}$ and $\alpha_{sub}$ are coefficient of thermal contraction of CTL and substrate respectively, and $Tg_{CTL}$ is the glass transition temperature of the CTL.

The Anti-Curl Back Coating Layer

An ACBC 1 is applied to the back side of the substrate 10 to counteract the curl and render flatness, as the imaging member web exhibits spontaneous upward curling after the completion of CTL 20 coating/drying and cooling processes. The ACBC should have a Young's Modulus of at least about $2.5\times10^5$ psi ($1.7\times10^4$ Kg/cm$^2$) and a thermal contraction coefficient of greater than about $4\times10^{-5}$/° C., to overcome the CTL tension strain (caused by CTL/substrate dimensional contraction differential) and impact good curl control for rendering imaging member flatness.

In the present disclosure, embodiments are directed generally to an improved flexible electrostatographic imaging member, particularly the flexible multiple layered electrophotographic imaging member or photoreceptor, in which the ACBC of this disclosure is formulated to have improve mechanical function, effect best curl control, and render desirable imaging member flatness.

The ACBC of the present disclosure comprises a film forming copolymer, such as, an A-B diblock copolymer having a generic formula:

Formula I $$R_1-\left(\left[\text{Block A}\right]_z\text{-}\left[\text{Block B}\right]_y\right)_n-OH$$

wherein block A is a carbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 90,000 and about 250,000 or between about 100,000 and about 200,000, or between about 110,000 and about 150,000.

The film forming A-B diblock copolymer used for ACBC formulation of present disclosure is a polycarbonate derived from different types of polycarbonates and by the inclusion of small fraction from one of different dicarboxylic acids into the polymer backbone, and the resulting copolymer contains from about 98 mole percent to about 80 mole percent, or from about 95 mole percent to about 85 mole percent of a carbonate segmental block A linearly linking to from about 2 mole percent to about 20 mole percent or from about 5 mole percent to about 15 mole percent of a segmental block B containing of a dicarboxylic acid terminal in the A-B diblock copolymer chain. In specific embodiments, the resulting copolymer contains about 90 mole percent of a segment block A linearly linking to about 10 mole percent of a segmental block B of an acid terminal in the A-B diblock copolymer chain.

The polycarbonate segment block A of the A-B diblock copolymer has the following structure:

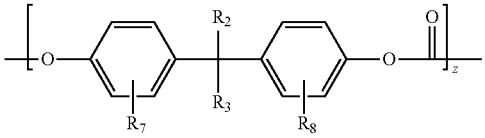

wherein each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_7$, $R_8$ is independently H or lower $C_1$-$C_3$ alkyl; and z is between about 8 and about 18, between about 27 and about 36, or between about 45 and about 54. In certain embodiments, each of $R_2$, $R_3$ is methyl, or $R_2$ and $R_3$ taken together with the C atom to which they are attached form a cyclohexane, where any ring atom of the cyclohexane may be optionally substituted with one or more methyl. In certain embodiments, each of $R_7$, $R_8$ is H or each of $R_7$, $R_8$ is methyl.

The segment block B of the A-B diblock copolymer has the following structure:

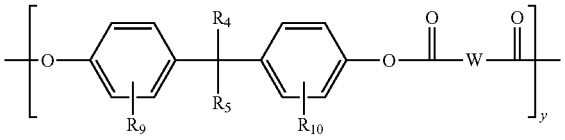

wherein each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_9$, $R_{10}$ is independently H or a lower $C_1$-$C_3$ alkyl; and y is between about 1 and about 2. In certain embodiments, each of $R_4$, $R_5$ is methyl, or $R_4$ and $R_5$ taken together with the C atom to which they are attached form a cyclohexane, where any ring atom of the cyclohexane may be optionally substituted with one or more methyl. In certain embodiments, each of $R_9$, $R_{10}$ is H or each of $R_9$, $R_{10}$ is methyl.

In specific embodiments, the film forming A-B diblock copolymer used for ACBC formulation of present disclosure is a polycarbonate derived from the bisphenol A polycarbonate structure by the inclusion of small fraction of dicarboxylic acid into the polymer backbone, and the resulting copolymer contains about 90 mole percent of a bisphenol A segment block A linearly linking to about 10 mole percent of a segmental block B of dicarboxylic acid terminal in the A-B diblock copolymer chain.

Exemplary polycarbonates (Block A) include the following carbonates:

Formula A-1

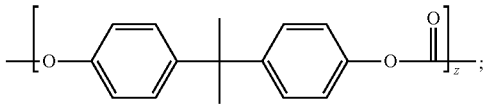

(bisphenol A carbonate)

Formula A-2

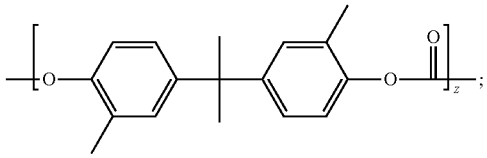

Formula A-3

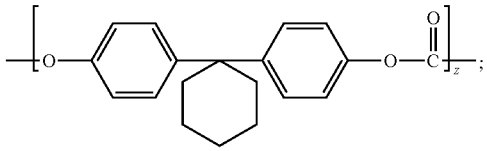

Formula A-4

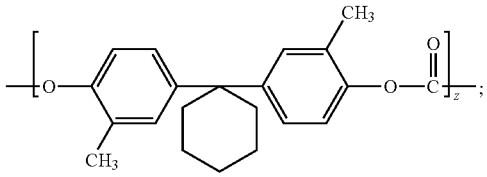

Formula A-5

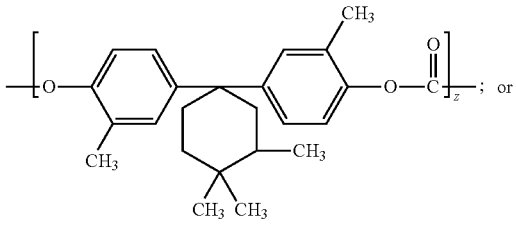

Formula A-6

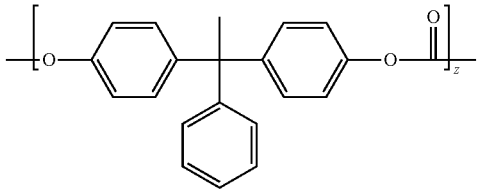

wherein z is an integer representing the numbers of repeating segmental carbonate unit, is from about 9 to about 18, from about 27 to about 36, or from about 45 to about 54.

The acid terminal units (Block B) have the following structures:

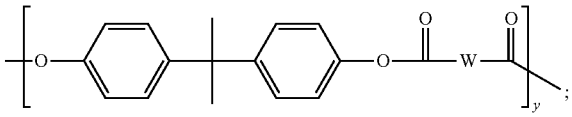

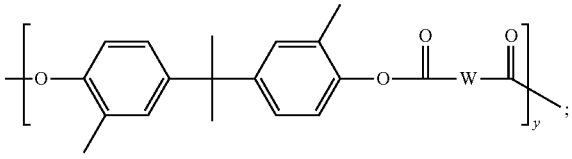

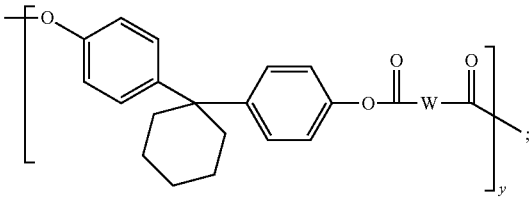

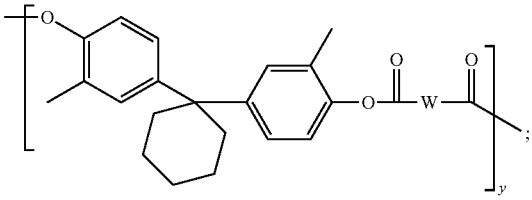

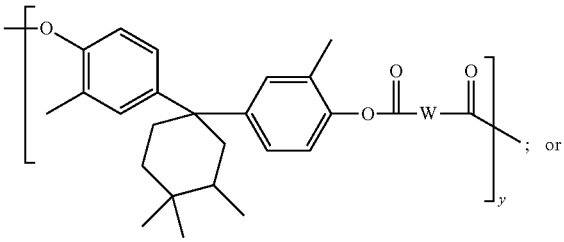

or

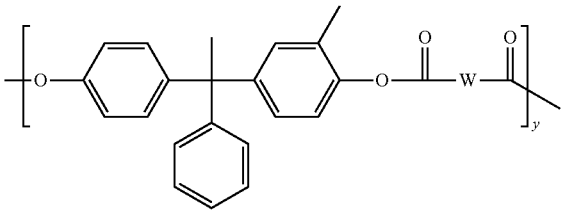

wherein W is an aromatic moiety or an aliphatic moiety, and y is from about 1 to about 6. In certain embodiments, W is an aryl having from 6 to 36 carbon atoms, or from 6 to 24. In certain of such embodiments, W is a phenyl. In certain embodiments, W is an alkylene having from 2 carbon atoms to 10 carbon atoms, from about 3 to about 8 carbons, or from 4 to 6 carbons.

In certain of such embodiments, the dicarboxylic acid terminal units have the following structures:

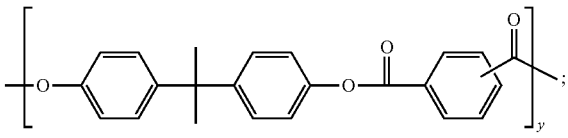

-continued

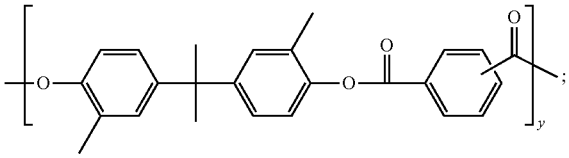

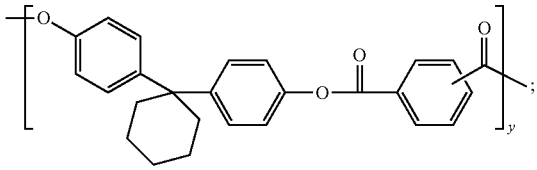

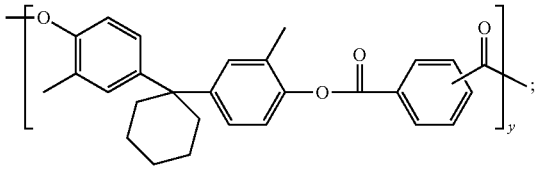

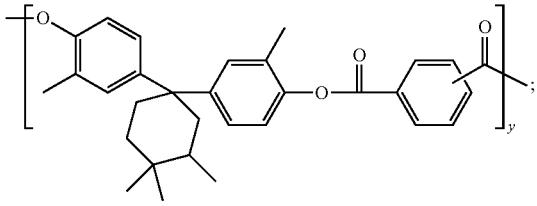

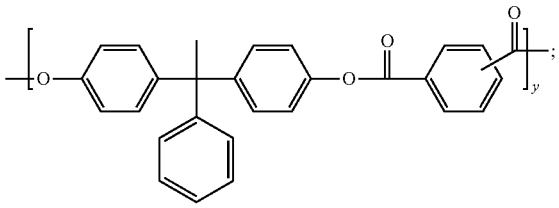

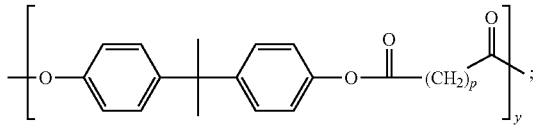

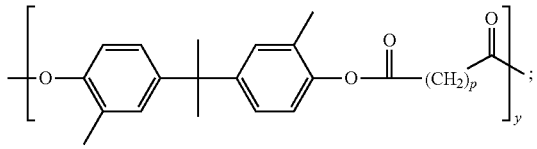

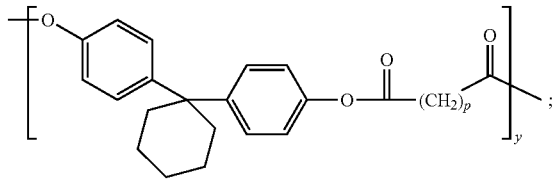

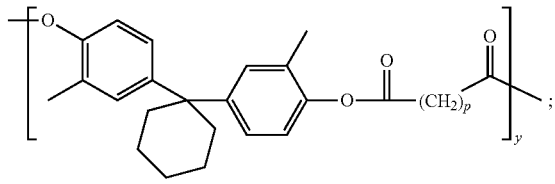

-continued
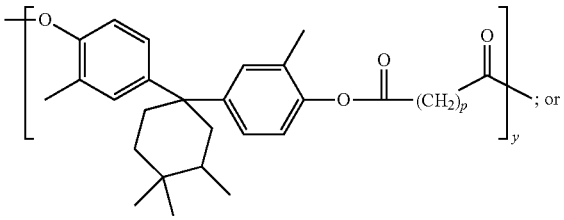
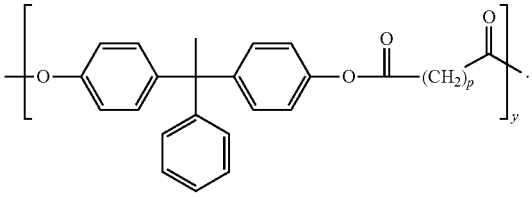
wherein p is from 3 to 8 or from 4 to 6; and y is from about 1 to about 6.
In yet certain of such embodiments, the dicarboxylic acid terminal units have the following structures:
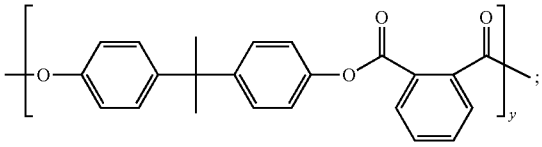
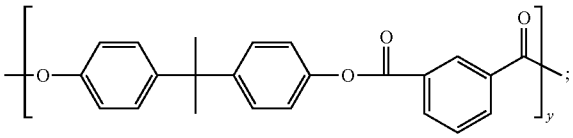
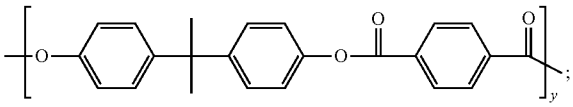
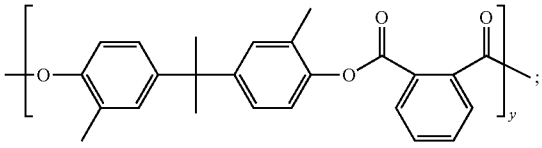
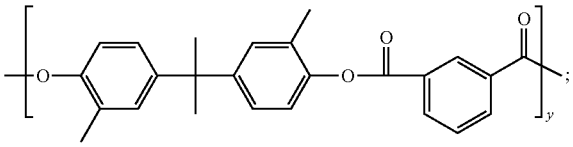
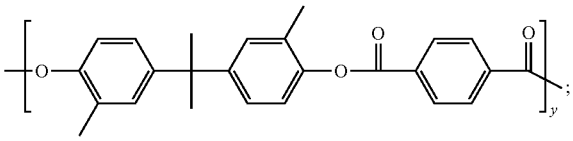
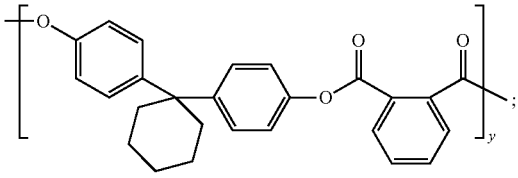
-continued
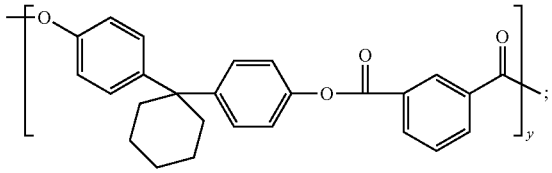
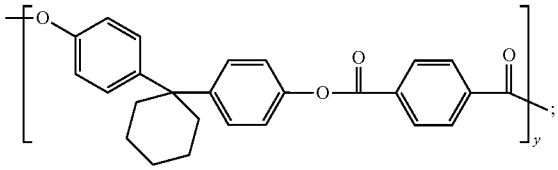
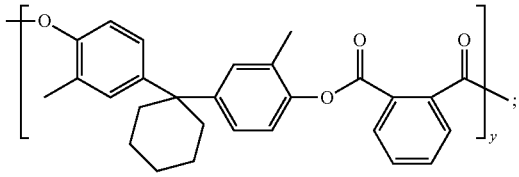
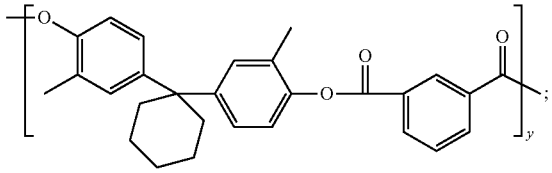
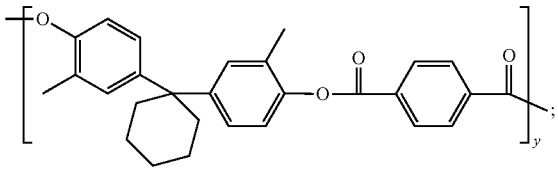
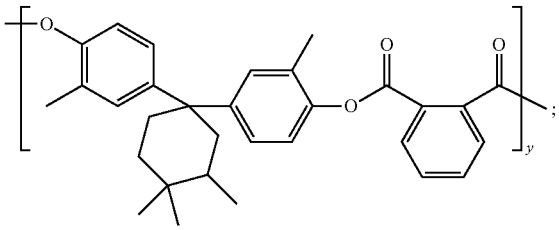
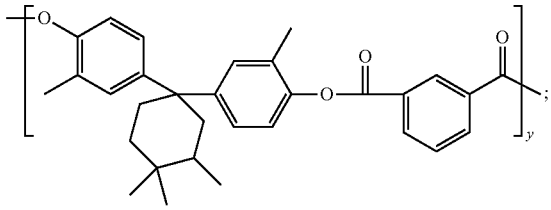
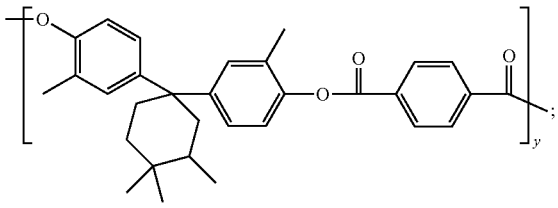
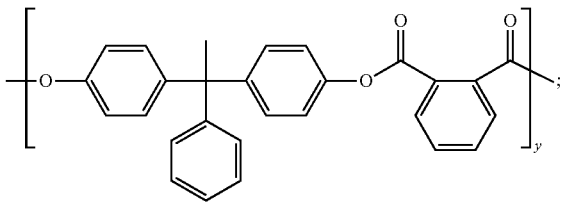

-continued
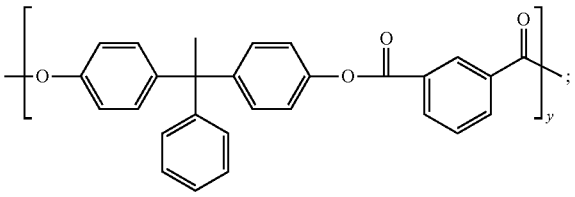
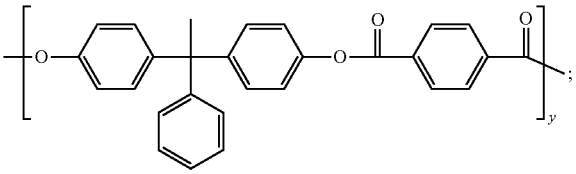
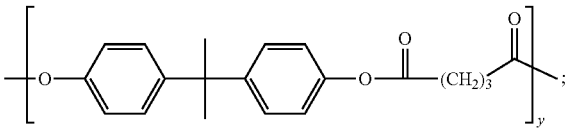
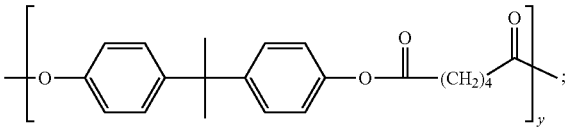
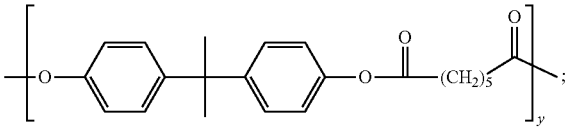
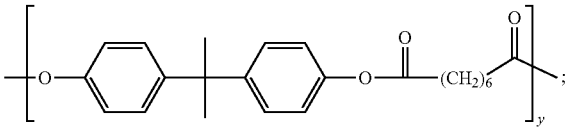
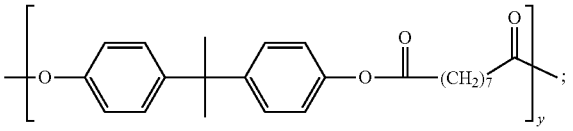
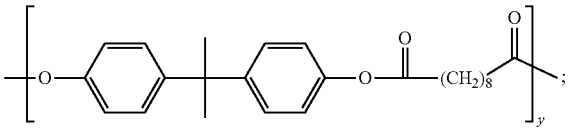
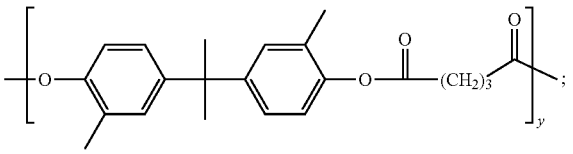
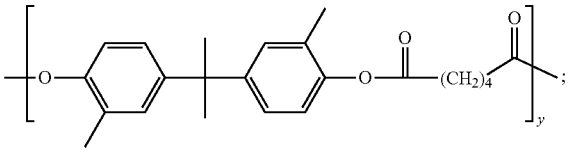
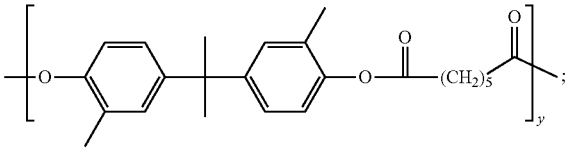
-continued
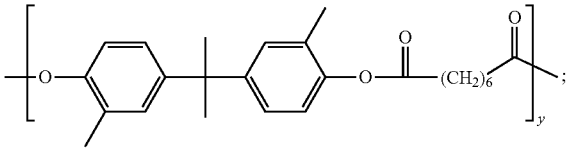
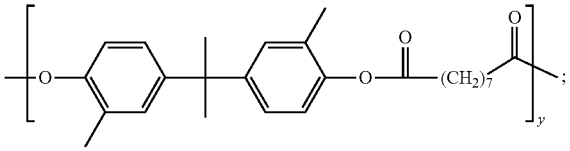
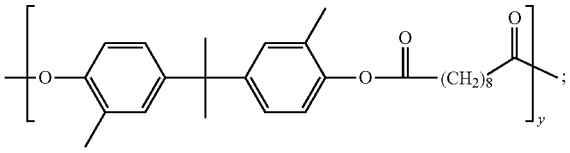
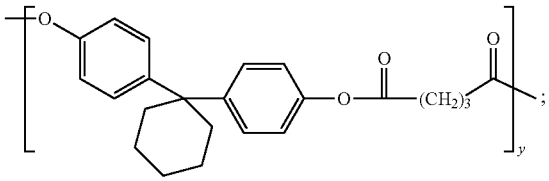
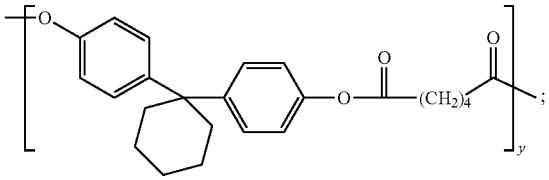
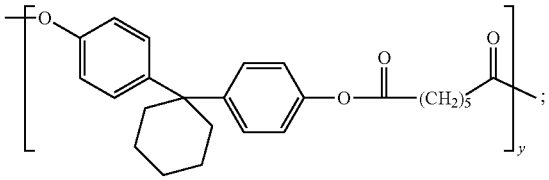
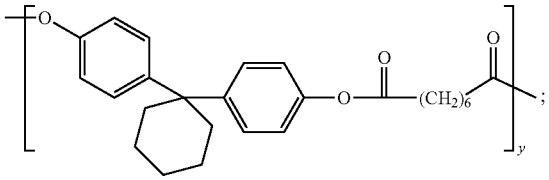
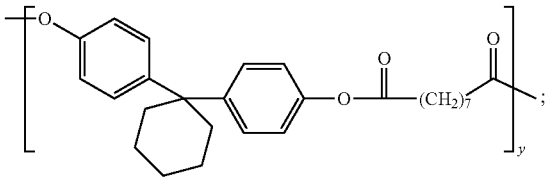
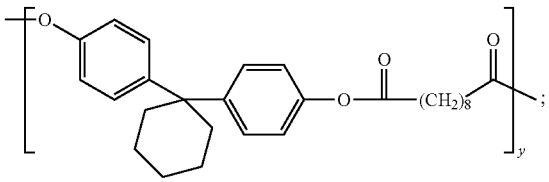
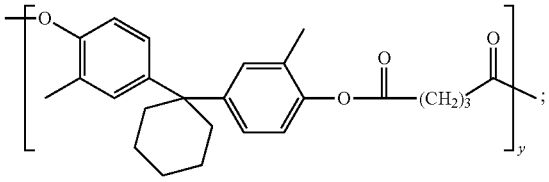

-continued

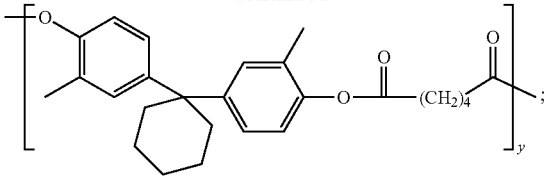

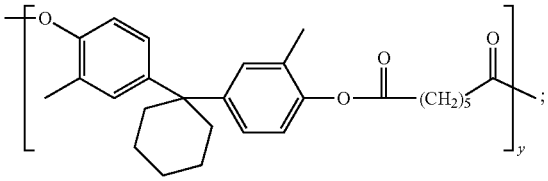

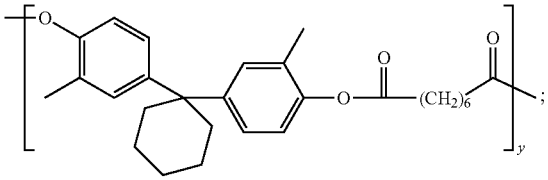

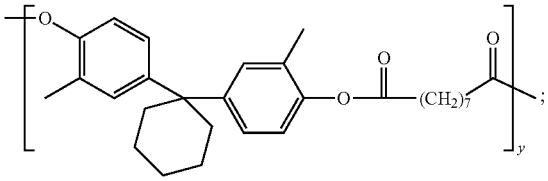

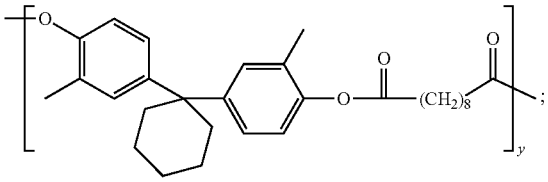

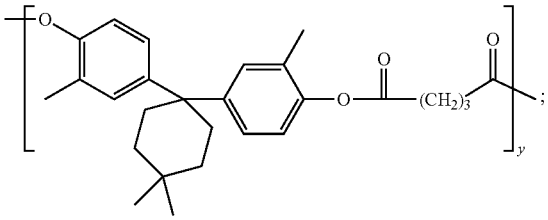

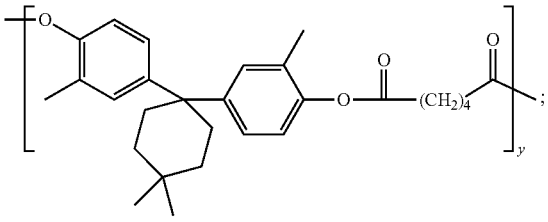

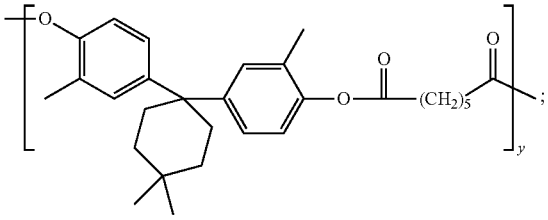

-continued

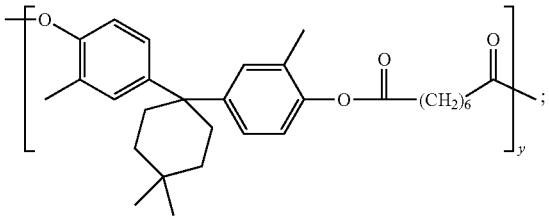

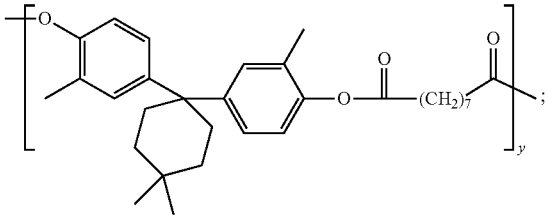

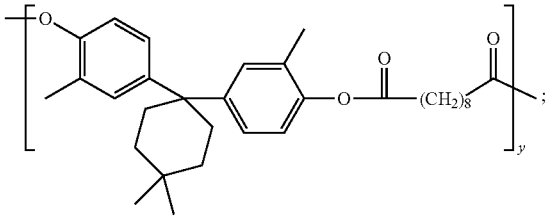

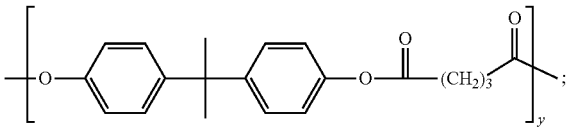

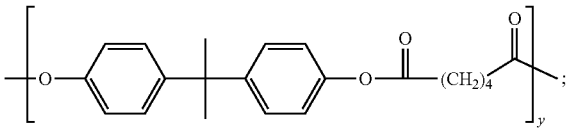

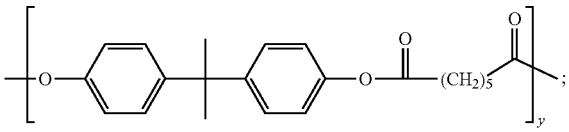

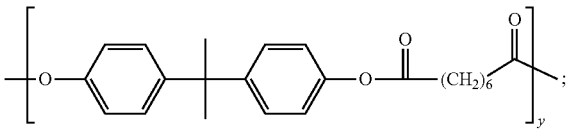

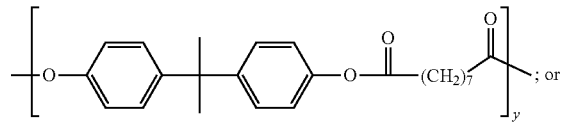

; or

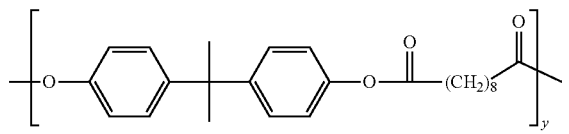

wherein y is 1 to 6.

In specific embodiments, the dicarboxylic acid segment in Block B may be derived from an aromatic dicarboxylic acid such as a phthalic acid, an terephthalic acid, an isophthalic acid, or derived from an aliphatic acid such as an glutaric acid, adipic acid, heptanedioic acid, octanedioic acid, azelaic acid, decanedioic acid, and the like as shown below:

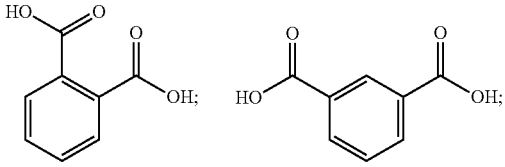

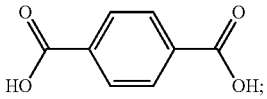

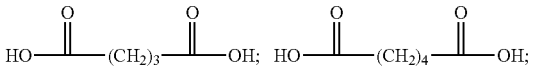

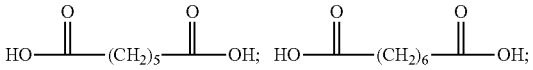

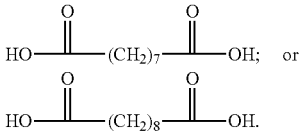

In certain embodiments, the A-B diblock copolymer has a structure of Formula II:

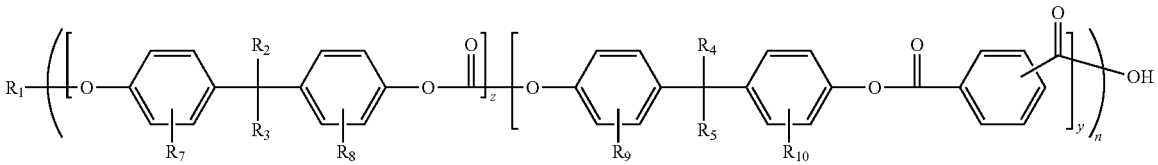

wherein the Block A and Block B are independently selected from the above lists described in the disclosure herein.

In certain embodiments, the A-B diblock copolymer has a structure of Formula III:

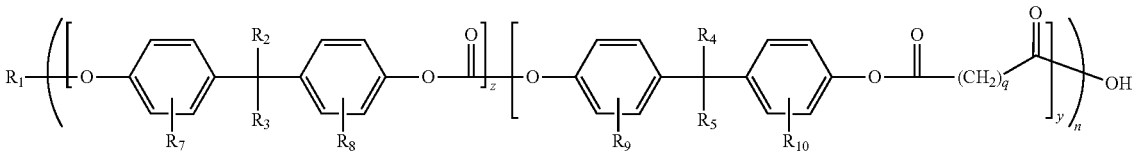

wherein the Block A and Block B are independently selected from the above lists described in the disclosure herein. $R_1$ to $R_5$ and $R_7$ to $R_{10}$ are defined in the present embodiments.

Those skilled in the art will recognize that A-B diblock copolymer discloses specific structures as if the combinations were individually drawn out. By way of illustration, specific examples of the compounds of this embodiment as disclosed above in the A-B diblock copolymer are as follows.

Block A selected from Formula A-4 and block B selected from the dicarboxylic acid terminal unit having the following structure:

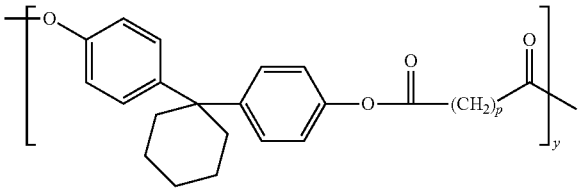

wherein p is 4, and Y is 1 to 6 together combine to form the following two A-B diblock copolymers:

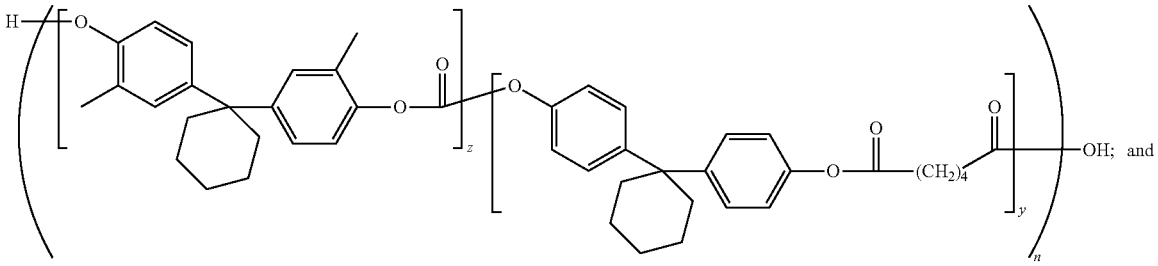
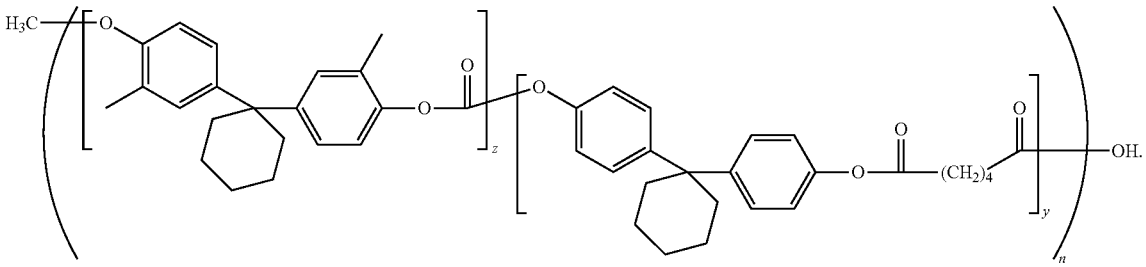
wherein y is 1 to 6, and n is between about 20 and about 80.
Block A selected from Formula A-2 and block B selected from the dicarboxylic acid terminal unit having the following structure:
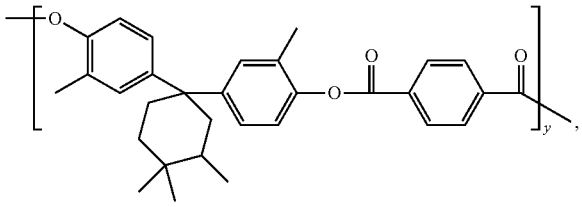
together combine to form the following two A-B diblock copolymers, wherein y is 1 to 6:
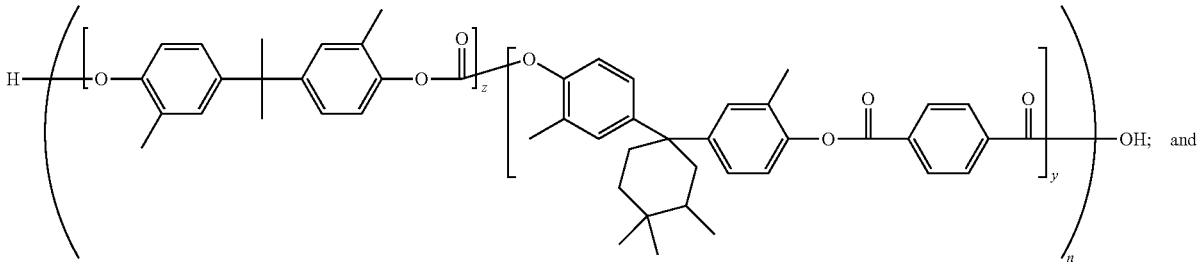

-continued

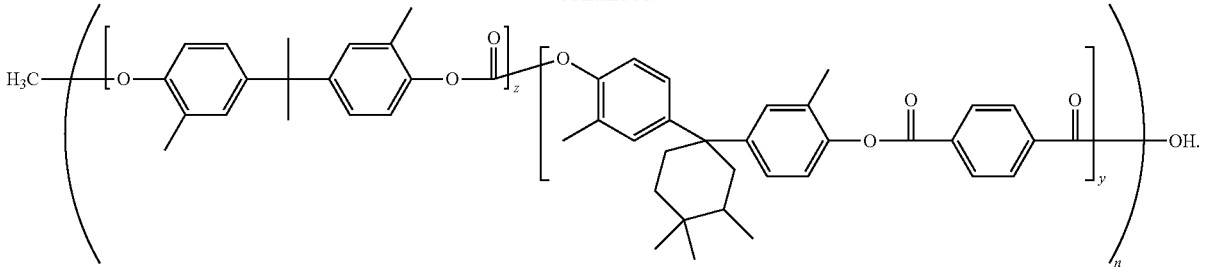

wherein y is 1 to 6, and n is between about 20 and about 80.

In certain embodiments, the flexible imaging member comprises a mixture of one or more copolymer (or A-B diblock copolymer) described in the disclosure.

In specific embodiments, the flexible imaging member comprises a copolymer of formula 1, or formula 2, or a mixture thereof:

Formula 1

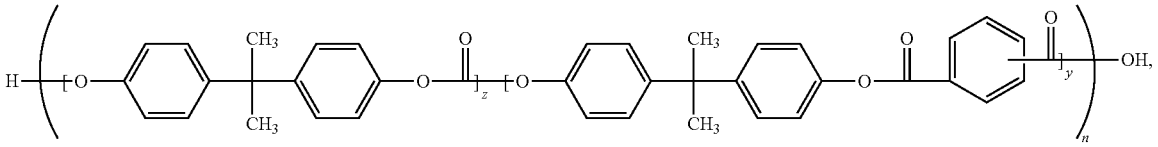

Formula 2

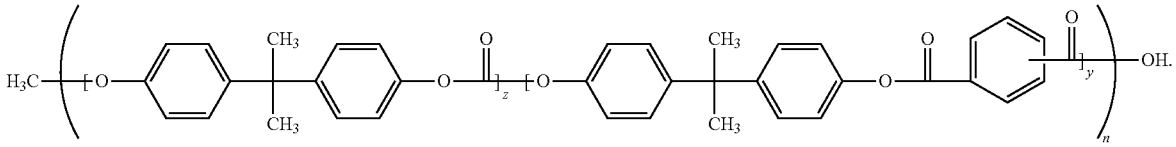

Generally, an ACBC comprises an A-B diblock copolymer of present disclosure having a thickness of from about 5 micrometers to about 50 micrometers to provide adequate counteracting capacity against the imaging member upward curling and render absolute member flatness. In certain embodiments, an ACBC comprises an A-B diblock copolymer having a thickness of from about 10 micrometers to about 20 micrometers, especially when the CTL of the imaging member has a thickness of from about 20 to 30 micrometers.

Figure 2:
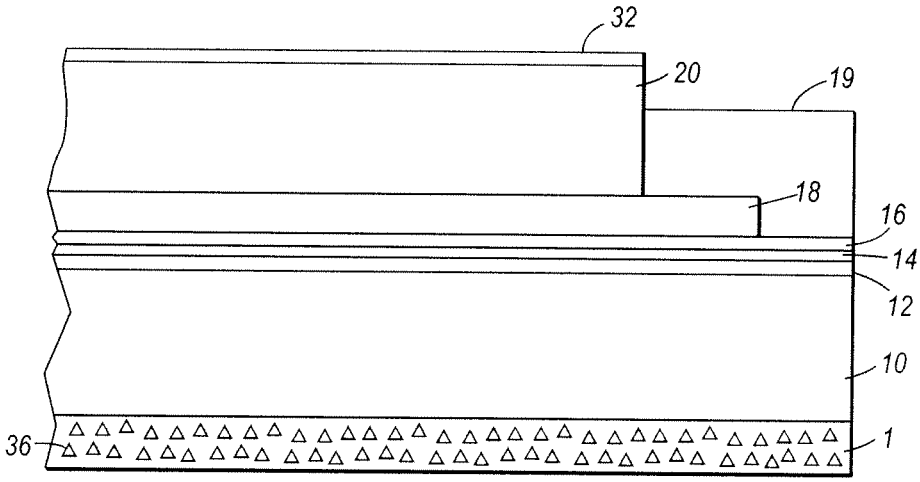
FIG. 2 is a schematic cross-sectional view of a second exemplary embodiment in which the anti-curl back coating of the flexible imaging member, prepared according to the present disclosure, includes an organic particles dispersion.

In certain embodiments, the ACBC may further include an organic particle dispersion. As shown in FIG. 2, it demonstrates a flexible multi-layered electrophotographic imaging member prepared according to the exact same material formulations, compositions, layer dimensions, methodology, and procedures as those described in each of the embodiments described in FIG. 1. In these embodiments, the imaging members comprise the exact same substrate 10, conductive ground plane 12, hole blocking layer 14, adhesive interface layer 16, CGL 18, CTL 20, and ACBC 1, but with the exception that the ACBC 1 of present disclosure in each imaging member is modified to incorporate homogeneous dispersion of organic particles 36 into its ACBC layer matrix for sliding contact friction reduction to effect scratch and wear resistance enhancement.

The organic particles 36 of interest for ACBC 1 material matrix dispersion used are selected, to include for example, polyterafluoroethylene (PTFE) available as ZONYL MP1100 and ZONYL MP1000 from E.I. du Pont de Nemours & company; waxy polyethylene having molecular formula $CH_3(CH_2)_mCH_3$, where m is between about 5 and about 15, available as ACUMIST from Allied-Signal, Inc.; Petrac Oleamide with a molecular formula $CH_3(CH_2)_7CH{=}CH(CH_2)_7C{=}OCNH_2$ available from synthetic Products company; and Petrac Erucamide with molecular formula $CH_3(CH_2)_7CH{=}CH(CH_2)_{11}C{=}OCNH_2$ available from synthetic Products company. The organic particles used are in a range of from about 3 micrometers to about 0.02 micrometer of average particle size and their dispersion is present in an amount of from about 1 to about 10 weight percent or from about 4 to 8 weight percent based on the total weight of the resulting ACBC layer 1.

Figure 3:
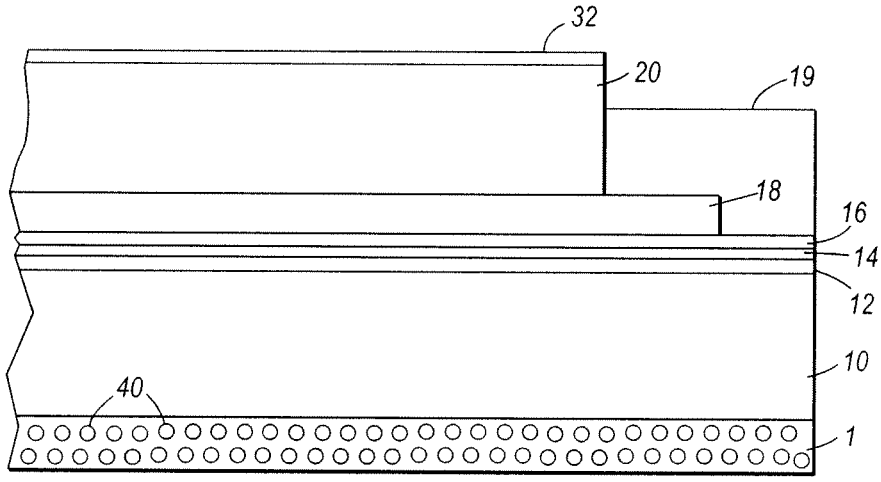
FIG. 3 is a schematic cross-sectional view of a third exemplary embodiment in which the anti-curl back coating of the imaging member, prepared according to the present disclosure, includes an inorganic particles dispersion.

In another certain embodiments, the ACBC may further include an inorganic particle. Embodiments of flexible imaging members shown in FIG. 3 are likewise prepared according to the exact same material formulations, compositions, layer dimensions, methodology, and procedures as those described in each of the embodiments described in FIG. 2. The imaging members comprise the exact same substrate 10, conductive ground plane 12, hole blocking layer 14, adhesive interface layer 16, CGL 18, CTL 20, and ACBC 1 of present disclosure, but with the exception that the organic particles 36 dispersed in ACBC 1 in each imaging member are being replaced by homogeneous inorganic particles dispersion 40 in its ACBC layer matrix. The inorganic particles 40 selected for ACBC dispersion are scratch/wear resistance hard particles such as, for example, microcrystalline silica available from Malvern Minerals Co., amorphous silica available from Degussa Corp., and various metal oxides such as aluminum oxide, titanium dioxide, Zirconium oxides, and the like, and mixtures thereof. The inorganic particles used are in a range of from about 3 micrometers to about 0.02 micrometer of average particle size and their dispersion is present in an amount of from about 1 to about 10 weight percent or from about 4 to 8 weight percent based on the total weight of the resulting ACBC layer 1.

Figure 4:
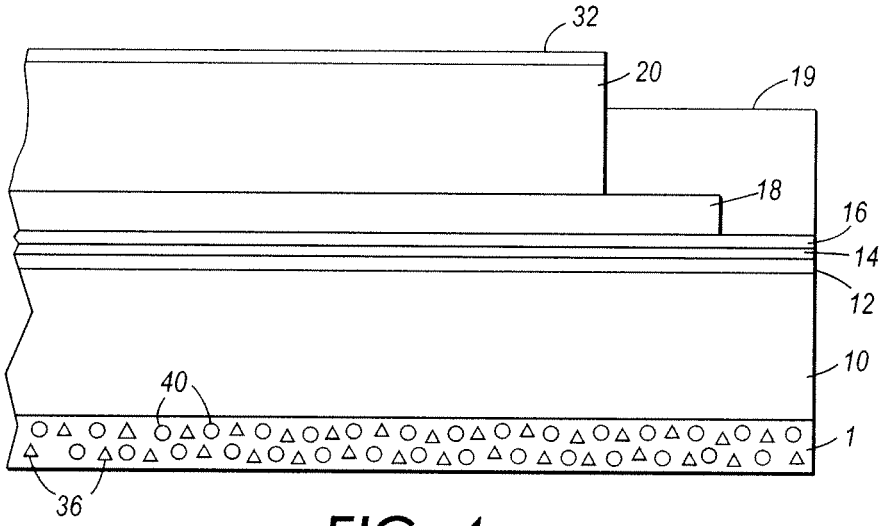
FIG. 4 is a schematic cross-sectional view of a fourth exemplary embodiment in which the anti-curl back coating of the flexible imaging member, prepared according to the present disclosure, includes a mixture of organic and inorganic particles dispersion.

In still another certain embodiments, the ACBC may further include a mixture dispersion of an organic particle and an inorganic particle. Referring to FIG. 4, extended embodiments of flexible imaging members, comprising all the exact same substrate 10, conductive ground plane 12, hole blocking layer 14, adhesive interface layer 16, CGL 18, and CTL 20, are prepared according to those descriptions detailed in all the preceding FIG. 1, except that the disclosed ACBC 1 is reformulated to include homogeneous dispersion of binary mixture of organic particles 36 and inorganic particles 40 in the layer matrix to impart the dual benefits of sliding contact reduction and scratch/wear resistance enhancement. The weight ratio of the organic particles to the inorganic particles (in all combination variances) is from about 10:90 to about 90:10, from about 70:30 to about 30:70, or about 50:50. The binary mixture of organic/inorganic particles dispersion is present in an amount of from about 1 to about 10 weight percent or from about 4 to 8 weight percent based on the total weight of the resulting ACBC layer 1.

The ACBC prepared to comprise the A-B diblock copolymer according to all the preceding embodiments detailed description of present disclosure does typically have a thickness of from about 5 micrometers to about 50 micrometers to provide adequate counteracting capacity to control the imaging member upward curling caused by greater dimension of CTL 20 than that of the substrate 10 and render absolute member flatness. In certain embodiments, the ACBC has a thickness of between about 10 micrometers and about 20 micrometers for an imaging member having a CTL of between about 20 and about 30 micrometers in thickness.

The ACBC of present disclosure may also include a adhesion promoter such as 49,000 resin (Rohm and Haas), Vitel PE-100, Vitel PE-200, Vitel PE-307 (from Bostik Inc.), in an amount of from about 2 to about 20 weight percent or from about 1 to 10 weight percent based on the combined weight of the diblock copolymer and the copolyester adhesion promoter in the ACBC layer. To impact contact friction reduction and greater scratch/wear resistance, the ACBC in the imaging members of all these embodiments may further prepared to incorporate an organic, an inorganic particles dispersion, as well as a binary mixture of organic/inorganic particles mixture (of from about 3 to about 0.02 micrometer average particle size) homogeneously dispersed in the resulting ACBC material matrix.

The copolymer is present in an amount of from about 80 to about 100 weight percent, from about 90 to about 99 weight percent, or from about 80 to about 98 weight percent based on the total weight of ACBC. In certain embodiments, The copolymer is present in an amount of about 100 weight percent based on the total weight of ACBC.

In further embodiments, the ACBC as prepared in accordance the description of this disclosure comprise variances of: (1) 100 weight percent of A-B diblock copolymer; (2) from about 99 to about 90 weight percent diblock copolymer with from about 1 and about 10 weight percent copolyester adhesion promoter; or (3) from about 80 to about 98 weight percent diblock copolymer with from about 20 to about 2 weight percent combined weight of adhesion promoter particle dispersion.

In essence, the present embodiments provide an ACBC design, prepared according of the descriptions of this disclosure, to have enhanced physical and mechanical properties, scratch/wear resistance, and good optical clarity of suitable transparency to allow good imaging member belt back erase by radiant light. Very importantly, the ACBC formulations of the present embodiments have excellent adhesion bonding strength to the substrate 10 and is also found to give effective anti-curling control capacity equivalent to that of the conventional polycarbonate ACBC having same coating layer thickness to render desirable imaging member flatness.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including nano particles of aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

In electrophotographic reproducing or digital printing apparatuses using a flexible imaging member belt prepared to comprise an ACBC of present disclosure, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the imaging member belt which has a charge-retentive surface. The developed toner image can then be transferred to a copy out-put substrate, such as paper, that receives the image via a transfer member.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Anticurl Back Coating Preparation

A conventional anticurl back coating (ACBC) layer was prepared by dissolving proper amount of bisphenol A polycarbonate in methylene chloride to give a 10% wt polycarbonate coating solution. The bisphenol A polycarbonate, poly (4,4'-isopropylidene diphenyl carbonate), is commercially available as FPC 0170 from Mitsubishi Chemicals. It has a molecular weight of about 120,000 and a molecular structure given in Formula X below:

Formula X

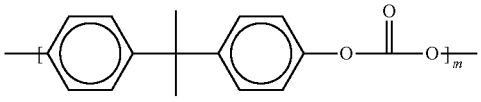

wherein n indicates the degree of polymerization.

An ACBC layer of present disclosure was likewise prepared by dissolving proper amount of an A-B diblock copolymer in methylene chloride to give a 10% wt copolymer coating solution. The A-B diblock copolymer is a film forming polymer available as LEXAN HLX from Sabic Innovative Plastics and having the molecular formulas consisting of:

In the above Formulas 1 and 2, the ratio of z:y is 9:1 for a molecular weight of about 115,000.

Both the prepared solutions were each applied over a release surface, by following the standard hand coating procedure, and then dried at 120° C. in an air circulating oven for two minutes to give a conventional bisphenol A polycarbonate ACBC and an A-B diblock copolymer (LEXAN HLX) ACBC of this disclosure, having 17 micrometers respective thickness and absolute optical clarity.

Mechanical and thermal analysis results obtained for each ACBC showed that the conventional bisphenol A polycarbonate ACBC control has a Young's Modulus of $3.20\times10^5$ psi ($2.18\times10^4$ Kg/cm$^2$) and a thermal contraction coefficient of $6.2\times10^{-5}$/° C. compared to a Young's Modulus of $3.95\times10^5$ psi ($2.70\times10^4$ Kg/cm$^2$) and a thermal contraction coefficient of $4.8\times10^{-5}$/° C. for the ACBC prepared using the A-B diblock copolymer of present disclosure.

Control Imaging Member Preparation Example

A negatively charged flexible electrophotographic imaging member web (having same structural configuration shown in FIG. 1) was prepared by providing a 0.02 micrometer thick titanium layer coated substrate of a biaxially oriented polyethylene naphthalate substrate (PEN, available as KADALEX from DuPont Teijin Films.) having a thickness of 3½ mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

Formula 1

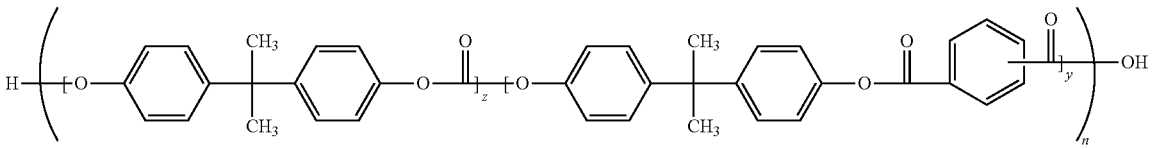

Formula 2

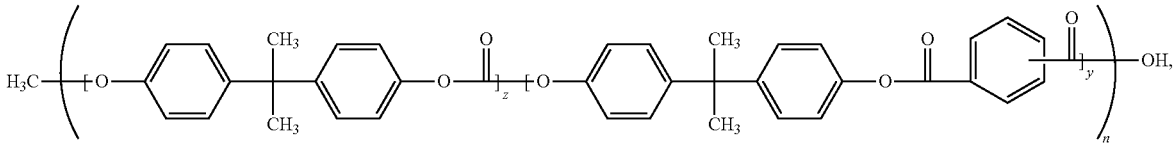

and mixtures thereof.

The adhesive interface layer was thereafter coated over with a charge generating layer. The charge generating layer dispersion was prepared by adding 0.45 gram of IUPILON 200, a polycarbonate of poly(4,4'-diphenyl)-1,1-cyclohexane carbonate (PC-z 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL) and a ground strip layer by co-extrusion of the coating materials. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine. The resulting mixture was dissolved to give 15 percent by weight solid in methylene chloride. This solution was applied on the charge generating layer by extrusion to form a coating which upon drying in a forced air oven gave a dry CTL 29 micrometers thick comprising 50:50 weight ratio of diamine transport charge transport compound to FPC0170 bisphenol A polycarbonate binder.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemicals) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip. Since the CTL, having a Young's Modulus of $3.4\times10^5$ psi ($2.18\times10^4$ Kg/cm$^2$), was about 3.7 times greater thermal contraction coefficient ($6.5\times10^{-5}$/° C.) than that ($1.8\times10^{-5}$/° C.). of PEN substrate support, so the imaging member web if unrestrained at this point would curl upwardly into a 1½-inch tube.

To effect imaging member curl control, a conventional ACBC was prepared by combining 88.2 grams of FPC0170 bisphenol A polycarbonate resin (same polymer used in the CTL binder) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The ACBC solution was then applied to the rear surface (side opposite to the charge generating layer and CTL) of the electrophotographic imaging member web by extrusion coating and dried to a maximum temperature of 125° C. in a forced air oven for 3 minutes to produce a dried ACBC having a thickness of 17 micrometers and flattening the imaging member. The flexible imaging member thus obtained was to serve as a control.

Disclosure Imaging Member Preparation Example I

A flexible imaging member web was also prepared by following the exact same procedures and using identical material compositions to form all the layers as those described in the Control imaging Member Preparation Example, except that the bisphenol A polycarbonate used to form the 17-micrometer thick conventional ACBC of the imaging member web was then replaced by a the novel A-B diblock copolymer LEXAN HLX. The imaging member thus prepared to comprise the reformulated ACBC of this disclosure did produce equal imaging member flatness control as that seen in the control imaging member.

Disclosure Imaging Member Preparation Example II

Another flexible imaging member web was also prepared by following the exact same procedures and using identical material compositions to form all the layers as those described in the preceding Disclosure imaging Member Preparation Example I, except that the A-B diblock copolymer LEXAN HLX ACBC was then modified to include 8% wt of VITEL PE-200 copolyester adhesion promoter (available from Bostik, Inc., Wauwatosa, Wis.), based on the total weight of the disclosed ACBC. The modified ACBC of this disclosure had optical clarity and the resulting imaging member thus prepared had absolute flatness.

Disclosure Imaging Member Preparation Example III

Another flexible imaging member web was also prepared by following the exact same procedures and using identical material compositions to form all the layers as those described in the preceding Disclosure imaging Member Preparation Example II, except that the ACBC comprising A-B diblock copolymer LEXAN HLX and adhesion promoter was further modified to include 5% wt polyterafluoroethylene (PTFE) dispersion (particle size of 0.2 micrometer and available as ZONYL MP1000 from E.I. du Pont de Nemours & company) in its layer matrix, based on the resulting weight of the disclosed ACBC. The modified ACBC of this disclosure had optical clarity and the resulting imaging member as prepared had absolute flatness.

Adhesion and Wear Testing

The three imagine member webs prepared according to the above disclosure of Working Examples were determined for each respective ACBC adhesion bond strength to the substrate and further assessed for the mechanical friction wear resistance against the conventional ACBC in the imaging member web control.

The ACBC adhesion bond strength to the substrate support of the imaging members was carried out by 180° peel strength measurement. Peel measurement test samples were prepared by cutting a minimum of three 0.5 inch (1.2 cm)×6 inches (15.24 cm) imaging member strips from every imaging member web of the four Working Examples. For each test sample strip, the ACBC was partially separated off from one end of the test strip (with the aid of a razor blade) and then hand peeled to give about 3.5 inches from that end to expose the substrate support layer the sample strip. This test sample strip was then secured to a 1 inch (2.54 cm)×6 inches (15.24 cm) and 0.05 inch (0.254 cm) thick aluminum backing plate (having the CTL facing and adhering to the backing plate) with the aid of two sided adhesive tape. The end of the resulting assembly, having the peeled off ACBC, was inserted into the upper jaw of an Instron Tensile Tester. The free end of the partially peeled ACBC was inserted into the lower jaw of the Instron Tensile Tester. The jaws were then activated at a one inch/mm. crosshead speed, a two inch chart speed and a load range of 200 grams, to peel the sample at least two inches at an angle of 180°. The load was calculated to derive the peel strength of the ACBC adhesion to the substrate. The peel strength was determined to be the load required for peeling off the ACBC divided by the width (1.27 cm) of the test sample strip.

For wear resistance assessment, the imaging member webs of all the Working were each again cut to give a size of 1 inch (2.54 cm) by 12 inches (30.48 cm) sample and then assed for resistance to wear of the ACBC. Testing was conducted by means of a dynamic mechanical cycling device in which glass tubes were skidded across the surface of the ACBC on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch width tension on the sample. The outer surface of the imaging member bearing the ACBC was faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the ACBC. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the ACBC was in sliding mechanical contact with a single stationary support tube during the testing. The rotation of the spinning disk was adjusted to provide the equivalent of 11.3 inches (28.7 cm) per second tangential speed. The extent of ACBC wear-off by the sliding contact friction against the glass tubes was measured using a permascope at the end of a 330,000 wear cycles test.

The results obtained for ACBC 180° peel-off strength and wear resistance are listed in Table I below:

TABLE I

| Working Example | PTFE in ACBC | Peel Strength (gms/cm) | Thickness Wear Off (microns) |
|---|---|---|---|
| Control | None | 4.6 | 10.8 |
| Disclosure I | None | 18.7 | 8.4 |
| Disclosure II | None | 98.3 | 8.1 |
| Disclosure III | 5% wt | 96.6 | 1.2 |

The data listed in the table above show that the electrophotographic imaging member of Control Example prepared to have ACBC comprising the conventional 4,4'-isopropylidene diphenol polycarbonate (the bisphenol A polycarbonate) had lower adhesion bond strength to the substrate and was substantially more susceptible to wear against sliding contact friction compared to the imaging member containing the ACBC reformulated by the use of the novel film forming A-B diblock copolymer of present disclosure. Additionally, it was also found that addition of 8% wt of a copolyester adhesion promoter to the ACBC of this disclosure could further improve its adhesion peel-off strength to the substrate support. Very importantly, the disclosed ACBC prepared to incorporate PTFE particles dispersion into its material matrix did provide great significant improvement to the layer's wear resistance.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A flexible imaging member comprising:

a flexible electrically conductive substrate;

a charge generating layer disposed on the substrate;

a charge transporting layer disposed on the charge generating layer; and an anti-curl back coating disposed on the substrate on a side opposite to the charge transport layer, the anti-curl back coating comprising a copolymer of Formula I:

$$R_1-\left(\text{[Block A]-[Block B]}\right)_n-OH$$

wherein Block A has the following structure:

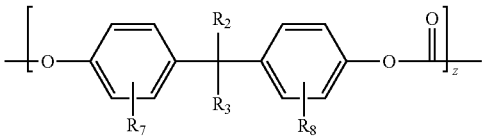

Block B has the following structure:

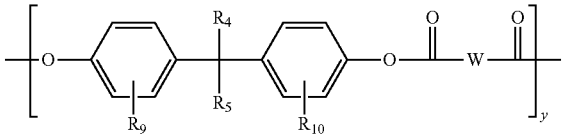

$R_1$ is H or $CH_3$;

each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl;

each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl;

each $R_7$, $R_8$, $R_9$, $R_{10}$ is independently H or lower $C_1$-$C_3$ alkyl;

W is an aryl or alkylene having from 2 carbon atoms to 10 carbon atoms;

y is between about 1 and about 6;

z is between about 9 and about 18; and n is between about 20 and about 80.

2. The flexible imaging member of claim 1, wherein each of $R_2$ and $R_3$ is methyl, or $R_2$ and $R_3$ taken together with the C atom to which they are attached form a cyclohexane, where any ring atom of the cyclohexane may be optionally substituted with one or more methyl.

3. The flexible imaging member of claim 1, wherein each of $R_4$ and $R_5$ is methyl, or $R_4$ and $R_5$ taken together with the C atom to which they are attached form a cyclohexane, where any ring atom of the cyclohexane may be optionally substituted with one or more methyl.

4. The flexible imaging member of claim 1, wherein each of $R_7$, $R_8$ is H.

5. The flexible imaging member of claim 1, wherein each of $R_7$, $R_8$ is methyl.

6. The flexible imaging member of claim 1, wherein each of $R_9$, $R_{10}$ is H.

7. The flexible imaging member of claim 1, wherein each of $R_9$, $R_{10}$ is methyl.

8. The flexible imaging member of claim 1, wherein Block A of the copolymer has the structure selected from the group consisting of:

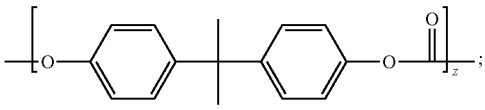

-continued

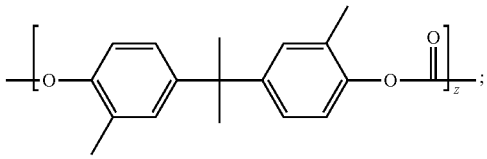

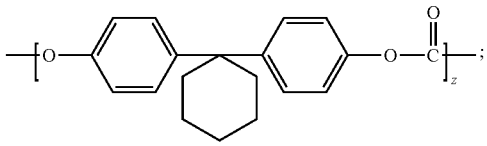

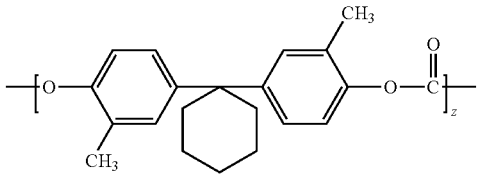

; and

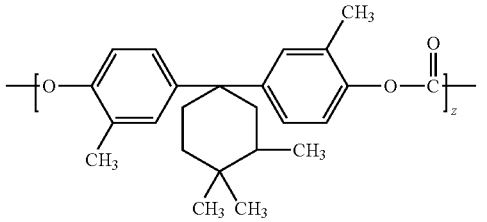

9. The flexible imaging member of claim 1, wherein Block B of the copolymer has the structure selected from the group consisting of:

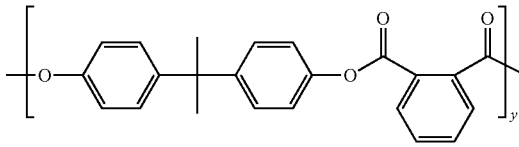

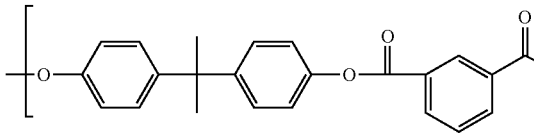

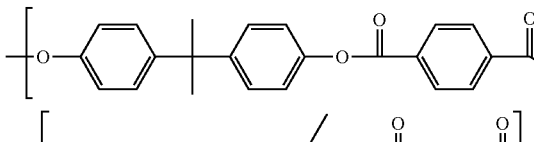

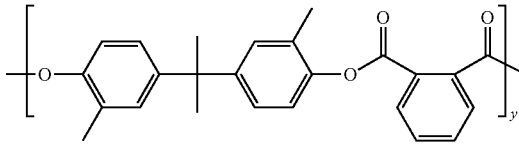

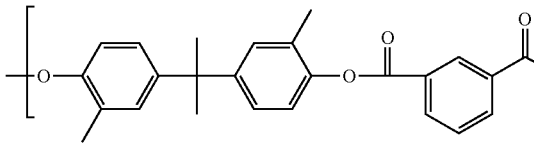

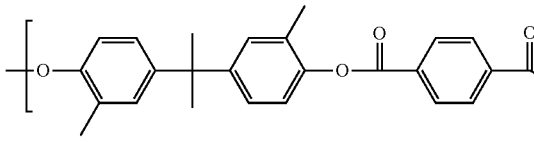

-continued
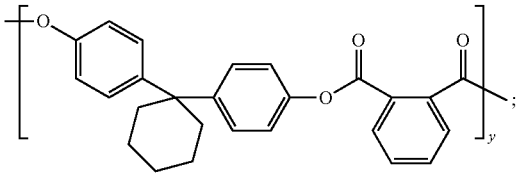
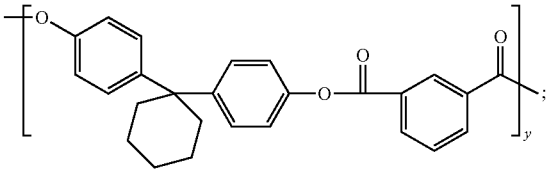
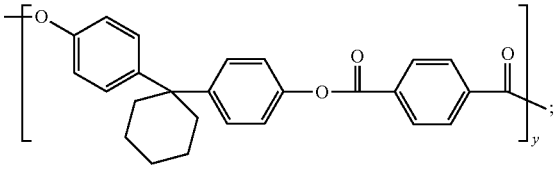
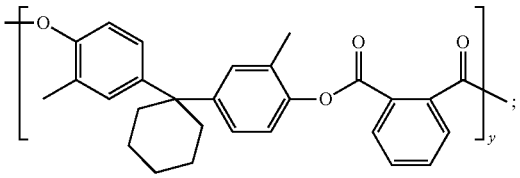
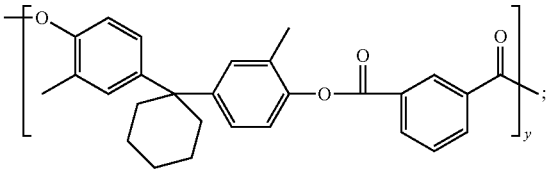
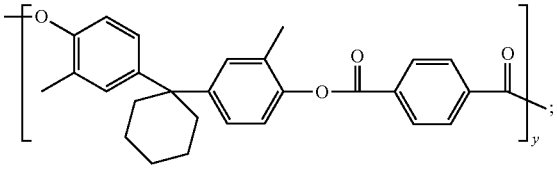
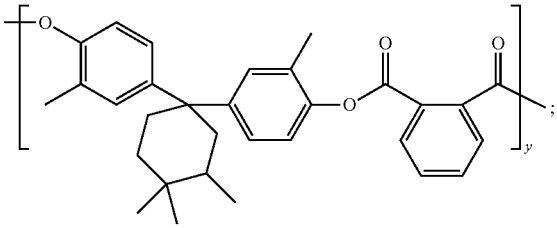
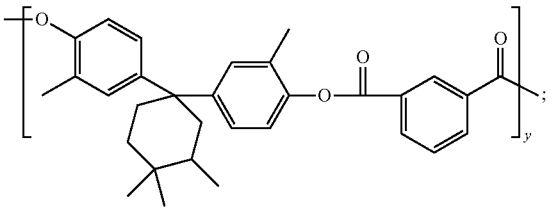
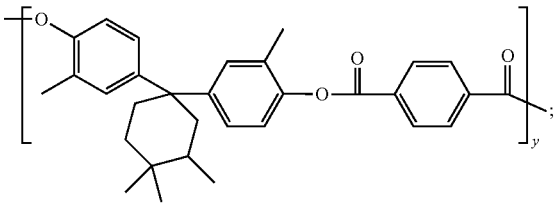
-continued
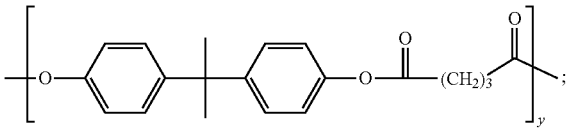
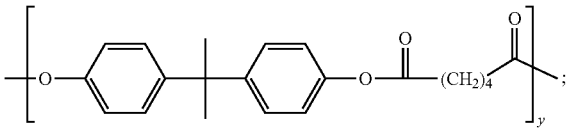
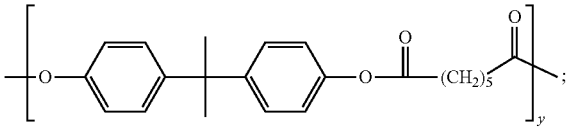
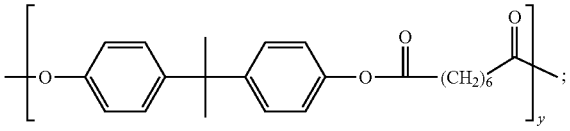
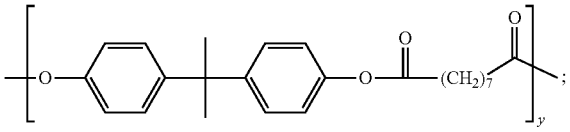
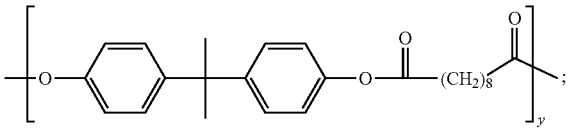
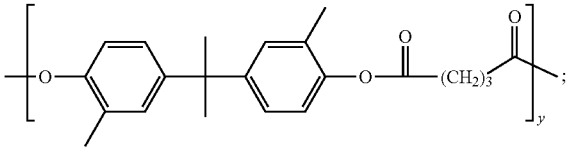
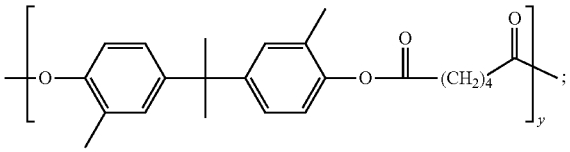
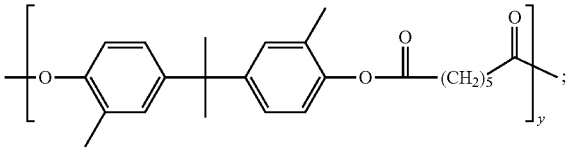
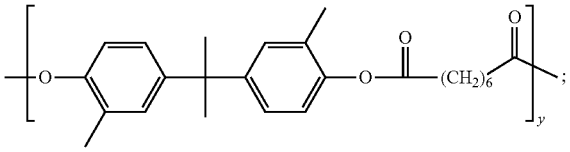
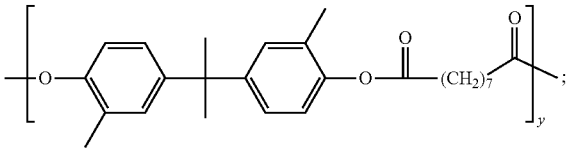
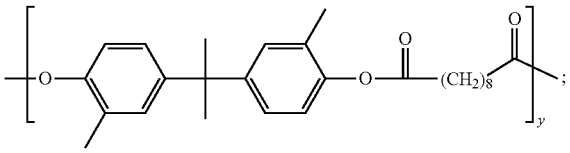

-continued
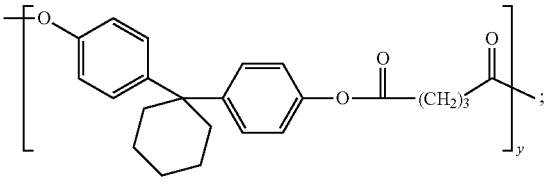
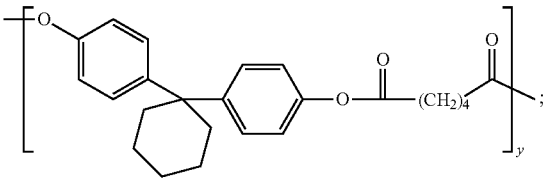
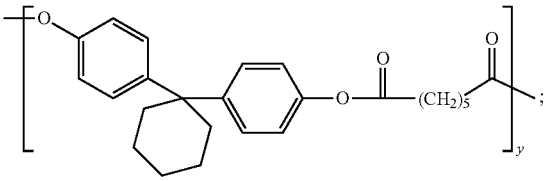
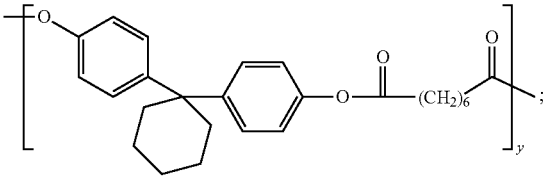
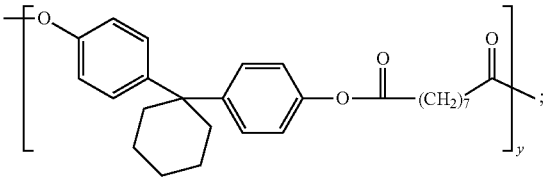
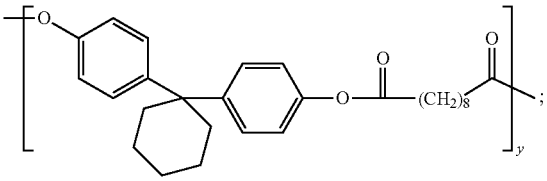
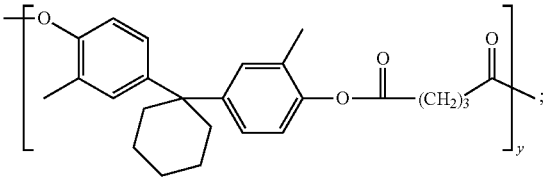
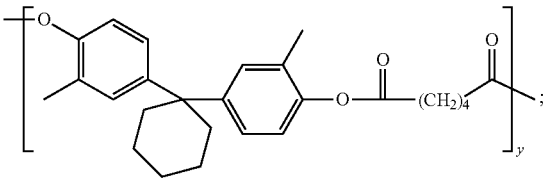
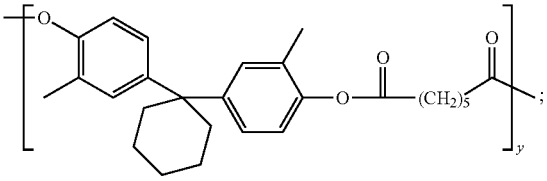
-continued
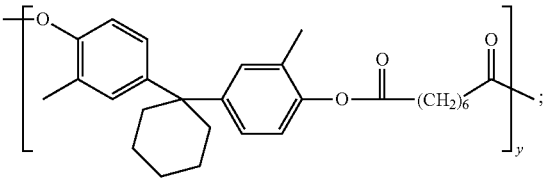
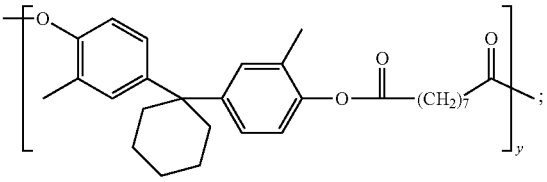
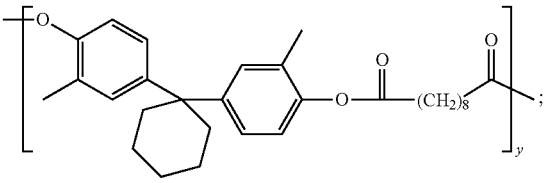
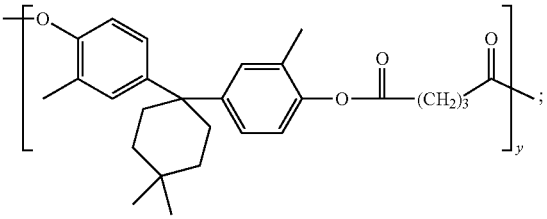
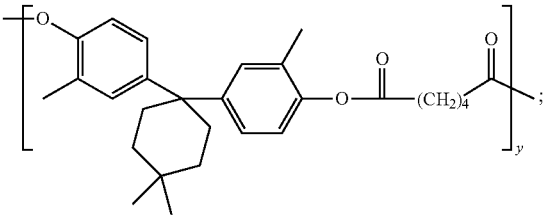
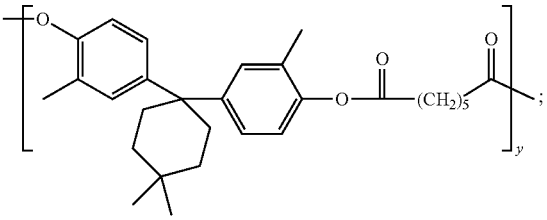
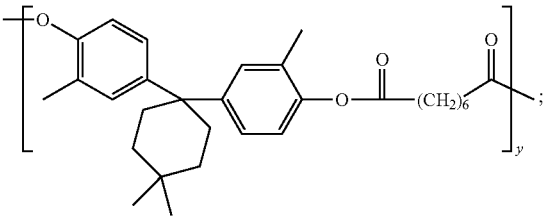

-continued

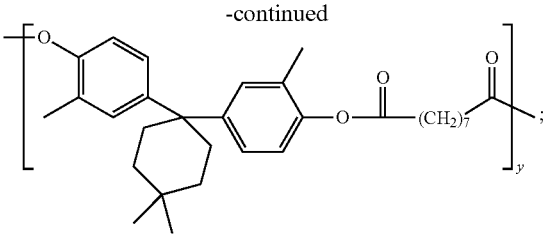

and

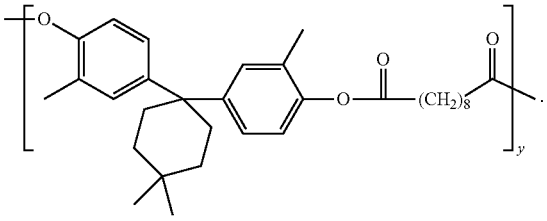

10. The flexible imaging member of claim 1, wherein the copolymer has the following structure:

Formula 1

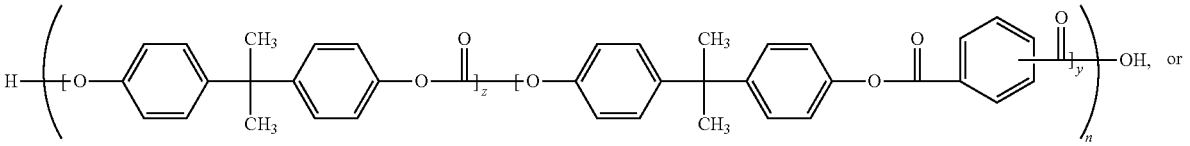

Formula 2

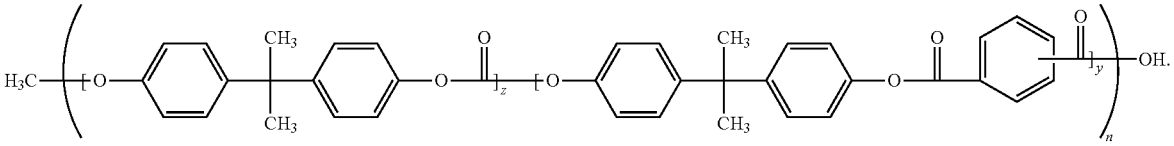

11. The flexible imaging member of claim 1, wherein the copolymer has a weight average molecular weight of from about 90,000 to about 250,000.

12. The flexible imaging member of claim 1, wherein the copolymer is present in an amount of from about 80 to about 100 weight percent based on the total weight of the anti-curl back coating.

13. The flexible imaging member of claim 1, wherein the copolymer comprises from about 98 mole percent to about 80 mole percent of block A linearly linking to from about 2 mole percent to about 20 mole percent of block B.

14. The flexible imaging member of claim 1, wherein the anti-curl back coating further comprises an adhesion promoter in an amount of from about 1 to about 10 weight percent based on the combined weight of the copolymer and the adhesion promoter.

15. The flexible imaging member of claim 1, wherein the anti-curl back coating further comprises an organic particle.

16. The flexible imaging member of claim 15, wherein the organic particle is polyterafluoroethylene.

17. The flexible imaging member of claim 15, wherein the organic particle is present in an amount of from about 1 to about 10 weight percent based on the total weight of the anti-curl back coating layer.

18. The flexible imaging member of claim 1, wherein the anti-curl back coating further comprises an inorganic particle.

19. The flexible imaging member of claim 18, wherein the inorganic particle is selected from the group consisting of microcrystalline silica, amorphous silica, metal oxide, and mixture thereof.

20. The flexible imaging member of claim 19, wherein the inorganic particle is present in an amount of from about 1 to about 10 weight percent based on the total weight of the anti-curl back coating layer.

21. The flexible imaging member of claim 1, wherein the anti-curl back coating further comprises an organic particle and an inorganic particle.

22. The flexible imaging member of claim 21, wherein the weight ratio of the organic particle to the inorganic particle is from about 10:90 to about 90:10.

23. The flexible imaging member of claim 22, wherein the organic particle and the inorganic particle is present in an amount of from about 1 to about 10 weight percent based on the total weight of the anti-curl back coating layer.

24. The flexible imaging member of claim 1, wherein the anti-curl back coating has a thickness of between about 5 micrometers and about 50 micrometers.

25. The flexible imaging member of claim 1, wherein the anti-curl back coating has a thickness of between about 10 micrometers and about 20 micrometers and the CTL has a thickness of between about 20 and 30 micrometers.

26. A flexible imaging member comprising:

an electrically conductive substrate;

a charge generating layer disposed on the substrate;

a charge transporting layer disposed on the charge generating layer; and an anticurl back coating disposed on the substrate on a side opposite to the charge transport layer, the anticurl back coating comprising a copolymer having a Formula III:

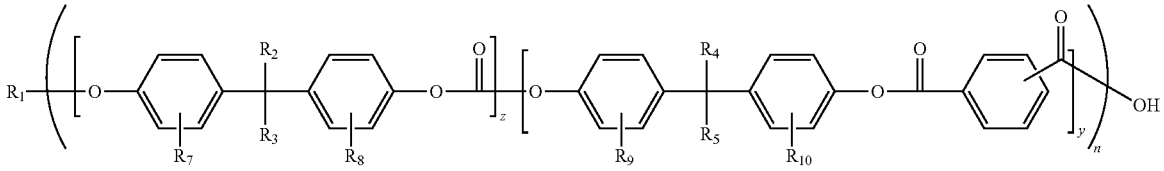

wherein $R_1$ is H or $CH_3$;

each $R_2$, $R_3$ is independently methyl, or $R_2$ and $R_3$ taken together with the C atom to which they are attached form a cyclohexane, where any ring atom of the cyclohexane may be optionally substituted with one or more methyl;

each $R_4$, $R_5$ is independently methyl, or $R_4$ and $R_5$ taken together with the C atom to which they are attached form a cyclohexane, where any ring atom of the cyclohexane may be optionally substituted with one or more methyl;

each $R_7$, $R_8$, $R_9$, $R_{10}$ is independently H or a methyl;

y is between about 1 and about 6;

z is between about 9 and about 18;

n is between about 20 and about 80; and q is between 3 and 8.

27. A flexible imaging member comprising:

a flexible electrically conductive substrate;

a charge generating layer disposed on the substrate;

a charge transporting layer disposed on the charge generating layer; and an anti-curl back coating disposed on the substrate on a side opposite to the charge transport layer, the anti-curl back coating comprising a copolymer of Formula I:

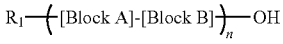

wherein Block A has the following structure:

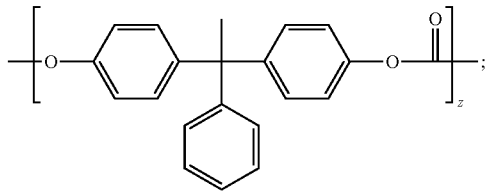

Block B has the following structure:

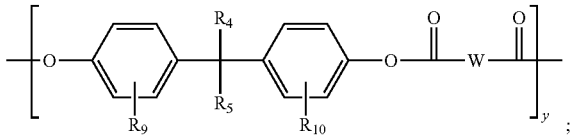

$R_1$ is H or $CH_3$;

each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl;

each $R_9$, $R_{10}$ is independently H or lower $C_1$-$C_3$ alkyl;

W is an aryl or alkylene having from 2 carbon atoms to 10 carbon atoms;

y is between about 1 and about 6;

z is between about 9 and about 18; and n is between about 20 and about 80.

* * * * *